US011028605B2

(12) United States Patent
Hemminga

(10) Patent No.: US 11,028,605 B2
(45) Date of Patent: Jun. 8, 2021

(54) THEATRE CONSTRUCTION

(71) Applicant: IMAGINE NATION B.V., Blaricum (NL)

(72) Inventor: Evert Lykle Hemminga, Blaricum (NL)

(73) Assignee: IMAGINE NATION B.V., Blaricum (NL)

( * ) Notice: Subject to any disclaimer, the term of this patent is extended or adjusted under 35 U.S.C. 154(b) by 0 days.

(21) Appl. No.: 16/647,427

(22) PCT Filed: Sep. 17, 2018

(86) PCT No.: PCT/EP2018/075101
§ 371 (c)(1),
(2) Date: Mar. 13, 2020

(87) PCT Pub. No.: WO2019/053271
PCT Pub. Date: Mar. 21, 2019

(65) Prior Publication Data

US 2020/0270885 A1 Aug. 27, 2020

(30) Foreign Application Priority Data

Sep. 15, 2017 (GB) ..... 1714933

(51) Int. Cl.
*E04H 3/30* (2006.01)
*A63G 31/16* (2006.01)
*A63J 1/02* (2006.01)

(52) U.S. Cl.
CPC ..... *E04H 3/30* (2013.01); *A63J 1/028* (2013.01)

(58) Field of Classification Search
CPC ..... A63G 31/00; A63G 31/04; A63G 31/16; A63J 1/028; E04H 3/30
USPC ..... 472/59–61, 130
See application file for complete search history.

(56) References Cited

U.S. PATENT DOCUMENTS 1,530,068 A 3/1925 Abrott
2,700,798 A 2/1955 Perrottet
4,066,256 A * 1/1978 Trumbull ..... A63G 31/16 434/59

(Continued)

FOREIGN PATENT DOCUMENTS

CN 2905930 Y 5/2007
CN 101552448 A 10/2009

(Continued)

OTHER PUBLICATIONS

International Search Report and Written Opinion dated Apr. 8, 2019 for International Application PCT/EP2018/075101 filed Sep. 17, 2018; 23 pages.

(Continued)

*Primary Examiner* — Kien T Nguyen
(74) *Attorney, Agent, or Firm* — Dickinson Wright PLLC

(57) ABSTRACT

A theatre construction comprises a seating area (120) for an audience, a circular support structure (134) surrounding the seating area and mounted above the seating area and a plurality of arcuate screens (135) suspended from the circular support structure. The screens (135) are mounted to the circular support structure (134) on rails for allowing movement of the screens about the seating area.

14 Claims, 21 Drawing Sheets

(56) References Cited

U.S. PATENT DOCUMENTS

| | | | | |
|---|---|---|---|---|
| 6,254,489 | B1 * | 7/2001 | Drobnis | A63J 5/021 472/59 |
| 2006/0138268 | A1 | 6/2006 | Huang | |
| 2007/0193123 | A1 | 8/2007 | Magpuri | |
| 2011/0042634 | A1 | 2/2011 | Boychuk | |

FOREIGN PATENT DOCUMENTS

| | | | |
|---|---|---|---|
| CN | 203034843 | U | 7/2013 |
| CN | 205502649 | U | 8/2016 |
| DE | 7914707 | U1 | 8/1981 |
| DE | 10200435 | A1 | 7/2003 |
| GB | 677383 | A | 8/1952 |
| JP | H06221010 | A | 8/1994 |
| JP | H11190139 | A | 7/1999 |
| WO | 9201132 | A1 | 1/1992 |
| WO | 2016015870 | A1 | 2/2016 |
| WO | 2017/105540 | A1 | 6/2017 |

OTHER PUBLICATIONS

Search Report for patent application GB1714933.7 dated Sep. 7, 2018; 3 pages.

Search Report for patent application GB1714933.7 dated Feb. 28, 2018; 8 pages.

"StageAroundImagine Nation"; https://www.youtube.com/watch?v=pzWReRwbp7g; YouTube.com video; Jan. 24, 2018 (date accessed in Search Report dated Sep. 5, 2018); Imagine Nation.

Intellectual Property Office of the United Kingdom, Search and Examination Report for Application No. GB2001432.0, dated Aug. 4, 2020; 8 pages.

Intellectual Property Office of the United Kingdom, Search and Examination Report for Application No. GB2001433.8, dated Aug. 4, 2020; 7 pages.

Intellectual Property Office of the United Kingdom, Search and Examination Report for Application No. GB2001435.3, dated Aug. 4, 2020; 7 pages.

Intellectual Property Office of the United Kingdom, Search Report Under Section 17 for Application No. GB2001433.8, dated Jan. 14, 2021; 4 pages.

Intellectual Property Office of the United Kingdom, Search Report Under Section 17 for Application No. GB2001435.3, dated Jan. 14, 2021; 4 pages.

* cited by examiner

THEATRE CONSTRUCTION

This invention relates to a theatre construction.

BACKGROUND

Traditional theatres comprise a tiered seating area facing performers on a stage. Performances in such theatres often have multiple parts or scenes that require different equipment or sets to compliment the actors' performance and improve the overall audience experience. These additional sets may be moved on and off the stage or hoisted in and out of the visible stage area during the performance when the stage curtain is lowered, so the audience is not aware of the changes taking place for the next part of the performance or during the course of the performance in view of the audience. This imposes limitations on the sets, as sets need to be designed with practicality in mind so that they can be moved on and off the stage, or hoisted in and out of the stage area, in a timely manner. Further, any sets not on the stage need to be stored off stage or suspended in the area above the stage. The space constraints of the theatre also limit the size and number of sets that can form part of a performance. However, as theatre technology has improved, designers have sought more impressive means to express their creativity and entertain an audience. One such means is the inclusion of a rotating seating area to improve the immersive experience provided by the performance. In this case, the scenery can stay fixed in position while the audience seating area rotates to view successive scenes. Ideally, for such systems to provide truly immersive experiences, visual cues such as lighting, staging and fire escape signage should be as invisible as possible during the performance to prevent the audience from determining the direction and extent of their rotation. A truly immersive experience should be one in which the audience does not have any idea which direction and by how much they are being moved and, therefore, what they might expect to see.

As the theatre-going audience becomes more accustomed to ever-increasing quality of production, it is the quality of the production that will provide a truly immersive experience to the audience. A quality performance must now incorporate outstanding lighting and sound configuration as well as the ability to truly disorientate the audience to provide a fully immersive experience.

A rotating seating area also has other problems. One such problem is how to manage the power lines and data cables that run from the fixed theatre building, for example a lighting desk or sound booth, to the rotating seating area to operate speakers and lighting attached to the rotating seating area. Cables cannot be subjected to significant twisting, as twisting a cable through multiple revolutions will result in mechanical damage as the core of the cable and insulating material is subjected to greater loads caused by the twisting of the cable.

Prior art revolving auditoriums typically comprise six or seven wheel tracks with a large number, typically in the hundreds, of undriven wheels to support the auditorium which is driven by a central motor. This has a high maintenance cost, as any broken wheels must effectively be left until such time as the auditorium cannot rotate and the whole system checked to determine which wheels need replacing. This is a highly expensive and inefficient system.

BRIEF SUMMARY OF THE DISCLOSURE

The present invention viewed from various aspects is defined in the appended claims.

BRIEF DESCRIPTION OF THE DRAWINGS

Embodiments of the invention are further described hereinafter with reference to the accompanying drawings, in which.

DETAILED DESCRIPTION

Creating a truly immersive theatre production requires multiple elements, each of which must be executed precisely to ensure the overall production is of the highest quality. The exemplary systems described herein achieve this by providing a system that is able to rotate multiple times in the same direction, while substantially isolating the audience from the visual cues that may allow them to orientate themselves during the performance. Further, a novel cable management system has been designed to ensure optimal and stable sound, light and video quality is maintained regardless of the orientation of the seating area and that the lighting and sound is synchronised to ensure there is no perceivable difference between the systems during the performance. Finally, a fire safety and emergency system that complies with regulatory requirements without compromising the quality of the performance has been devised. Examples of each of these elements are discussed here.

Theatre Construction

Figure 1A:
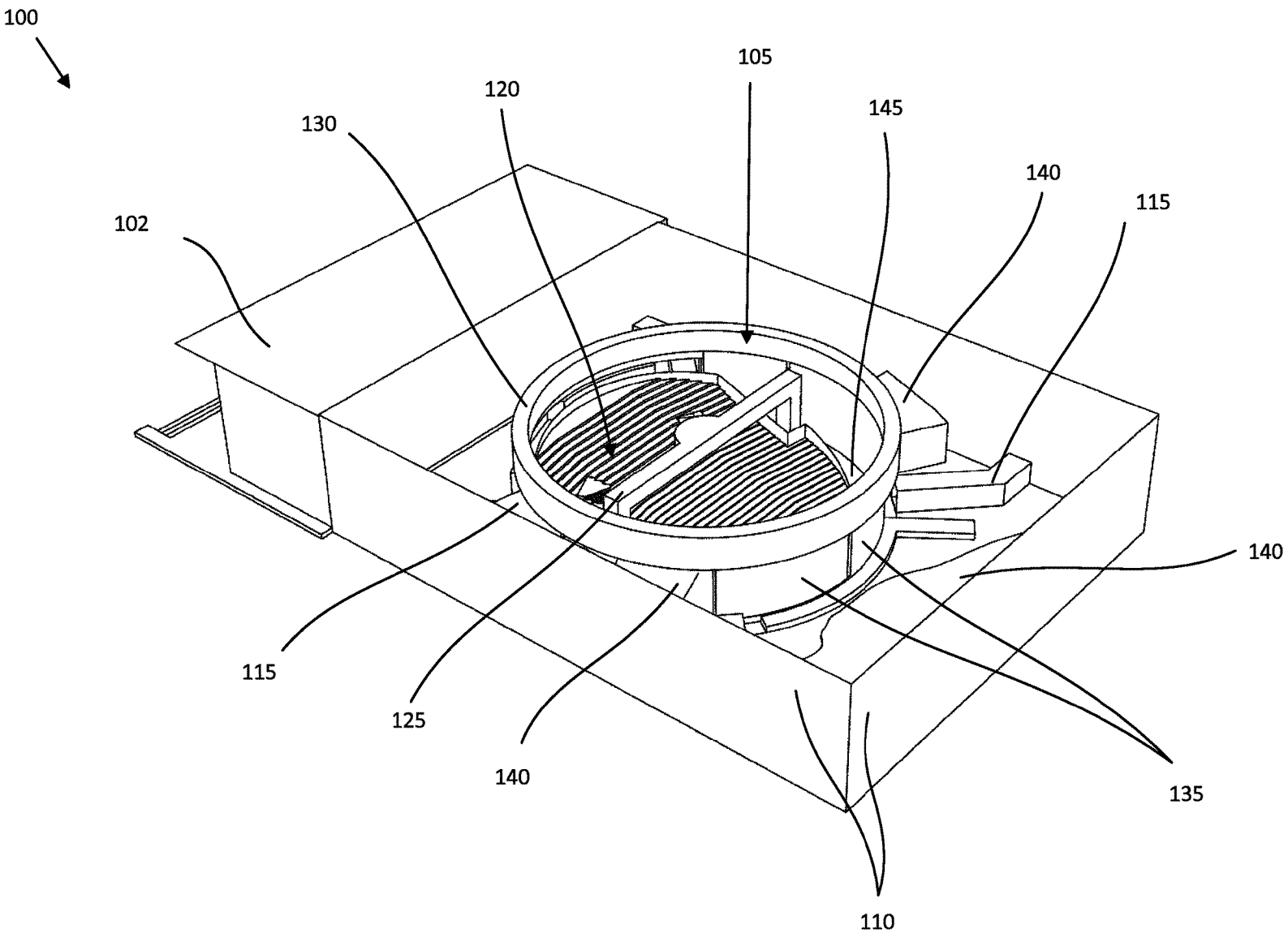
FIG. 1A shows an exemplary theatre construction having a revolving seating area and a plurality of sets.

FIG. 1A shows an exemplary theatre construction having a revolving seating area and a plurality of sets. A large open building, such as a warehouse or aircraft hanger is a suitable space in which the present system can be contained. The arrangement comprises a theatre 100 with a "drum" 105 located in the space defined by the building walls 110 and connected to a front of house building 102 by a series of entrance tunnels 115. The floor, the circular support structure 130, the screens 135, the crown truss 160 and the cloth ceiling 155 define the drum 105. Within the volume of the drum 105 are a rotating seating area 120 and a main bridge structure 125 to support projectors and lighting and audio equipment. The drum 105 is separated from the various sets and stages 140 by a series of moveable screens 135 which are supported by the round support structure 130. Additionally, an annular floor 145 on which performers can walk during the performance and which provides an entrance and exit route for the audience is located in front of the screens 135. The specific configuration of the different elements are best shown in FIG. 1B.

Figure 1B:
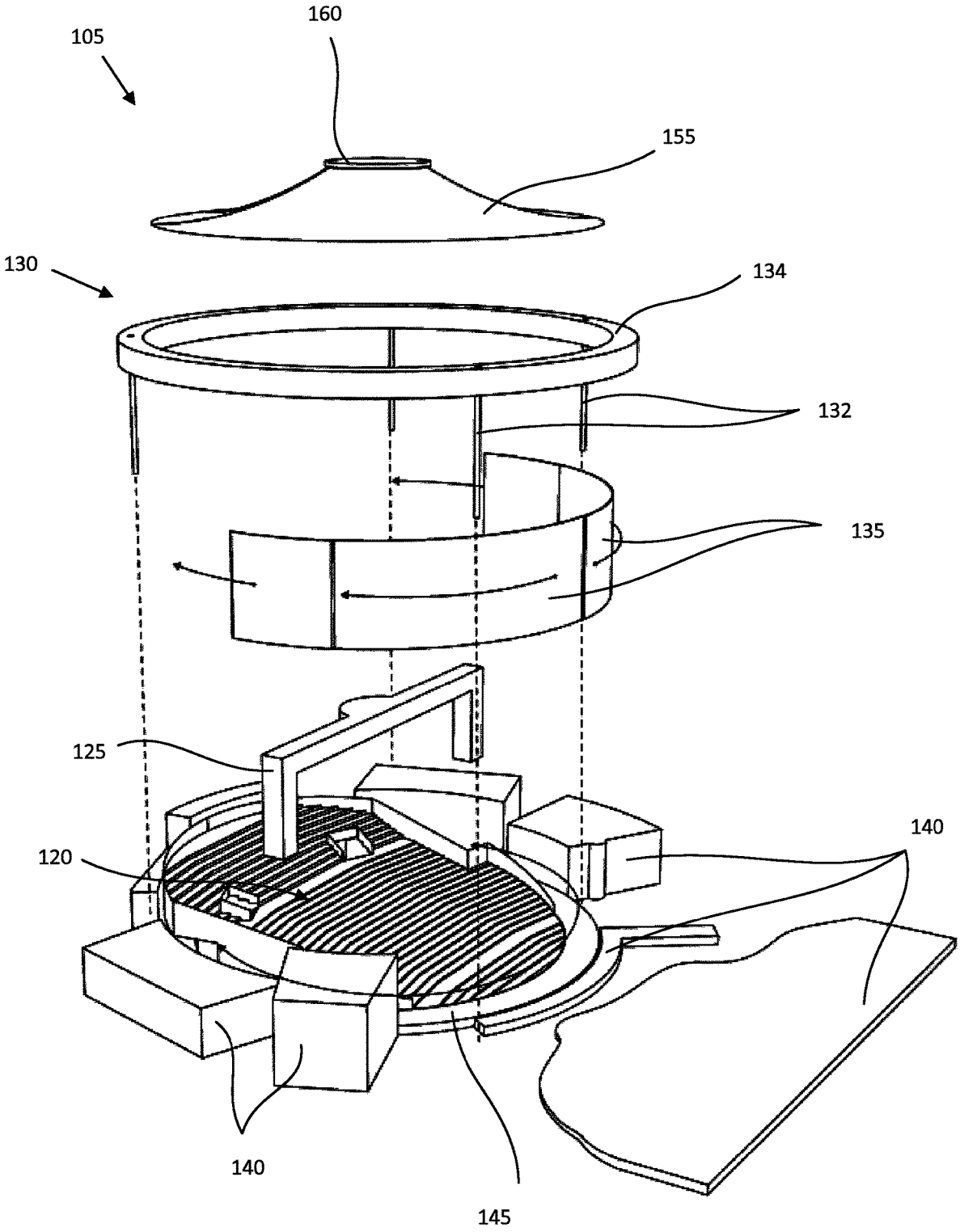
FIG. 1B shows an exploded view of a drum within a theatre construction.

FIG. 1B shows an exploded view of the drum within the theatre construction. As can be seen, the circular support structure 130 comprises a round truss 134 supported by a series of support poles 132 secured to the floor of the theatre 100. Both the seating area 120 and all screens 135 are moveable independently of one another. The theatre construction has a mesh or flannel ceiling 155 above the drum 105 attached to the round truss 134 and a crown truss 160, by which the audience is isolated from external reference landmarks that might enable them to locate themselves as the seating area 120 rotates. As the screens 135 can entirely cover the audience's field of view, the seating area 120 is able to rotate between different sets 140 without the audience knowing what to expect. As shown, two large screens and two smaller screens are used in the described embodiments. However, more or fewer screens may be used as required.

Traditional theatres will have a stage area approximately 10 m wide and 12 m deep. The present system has 125 m of stage width and a variable level of depth, depending only on the constraints of the building within which the drum 105 is housed. The scale of such a performance area is not possible in traditional theatres and provides a creative director with considerably greater flexibility when devising a show or performance.

Figure 1C:
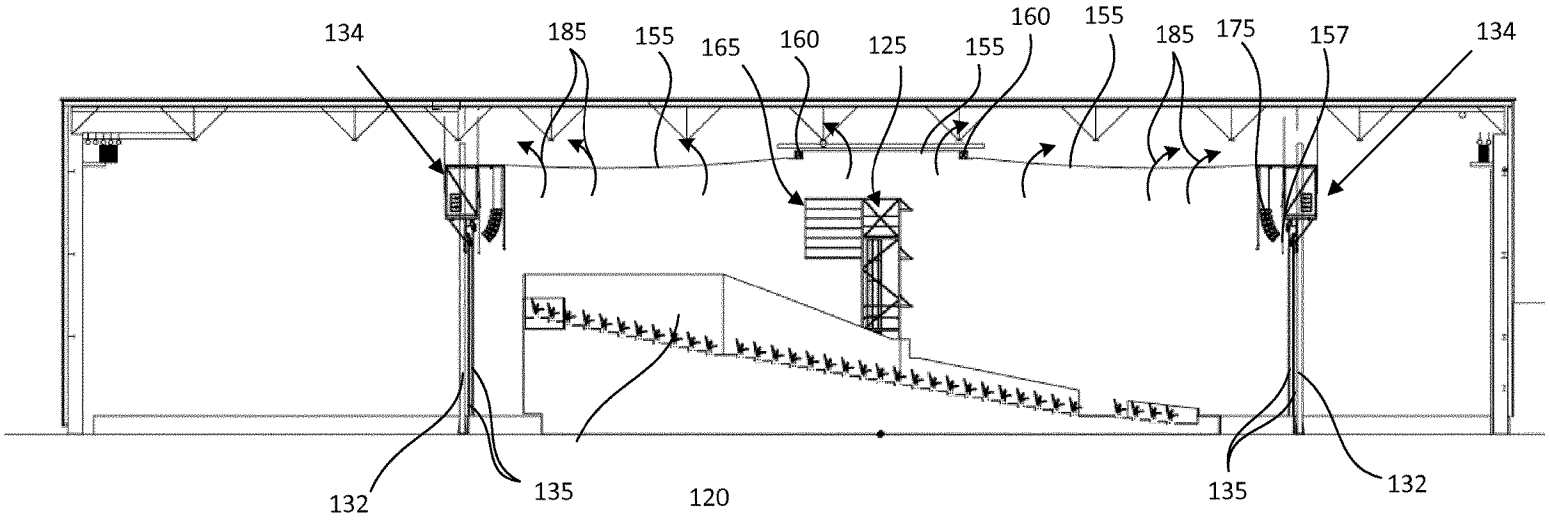
FIG. 1C shows a side section view of a theatre construction.
Figure 1D:
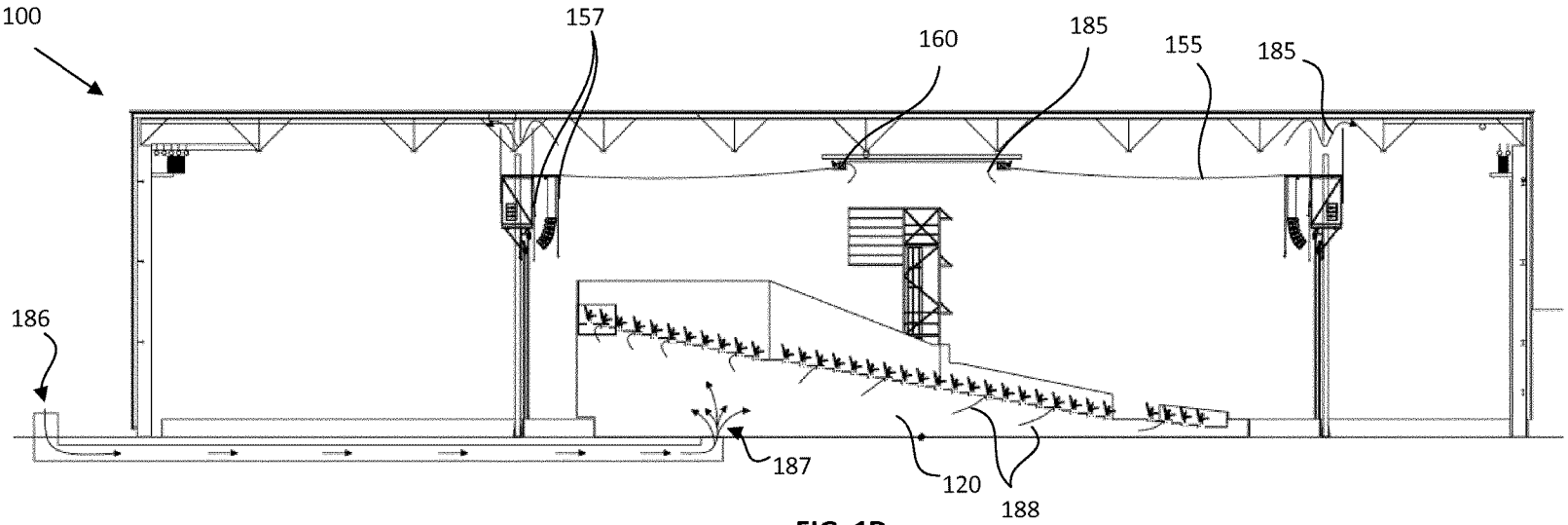
FIG. 1D shows a side section view illustrating the ventilation of a theatre construction.
Figure 1E:
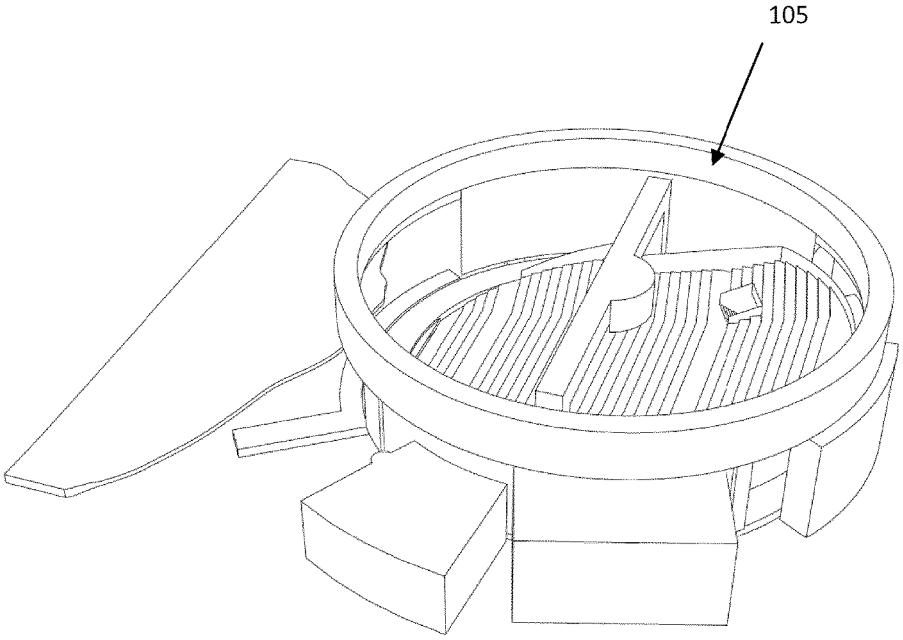
FIGS. 1E and 1F show an exemplary theatre configuration to provide a wide-angled view of a scene.
Figure 1F:
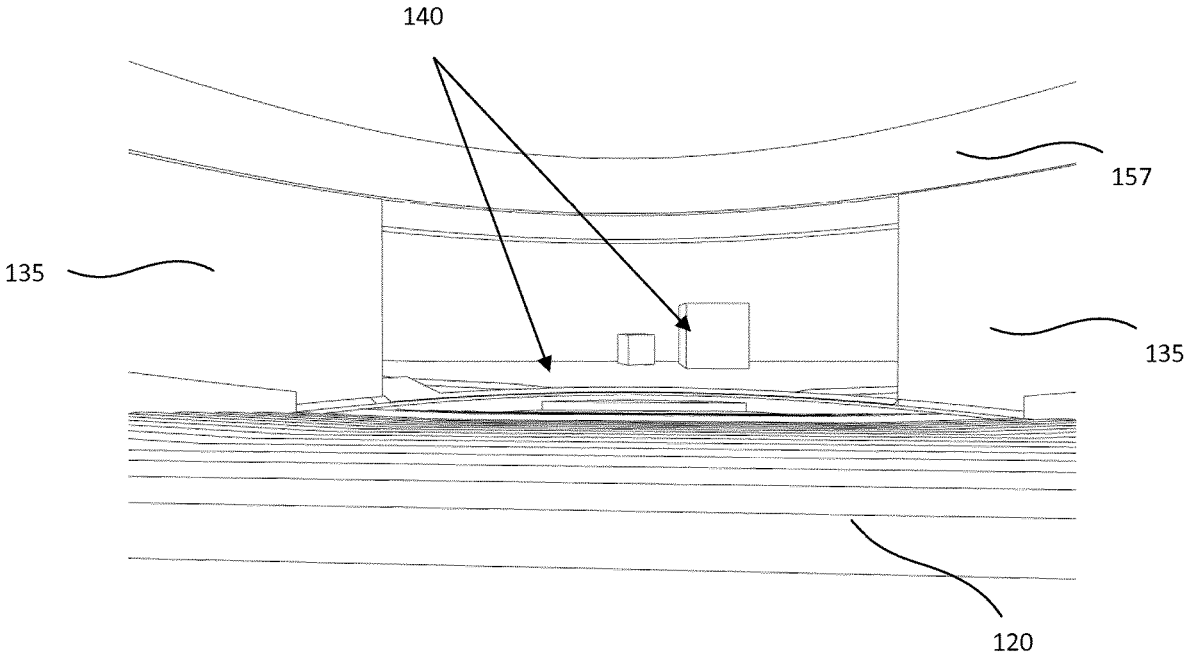
Figure 1G:
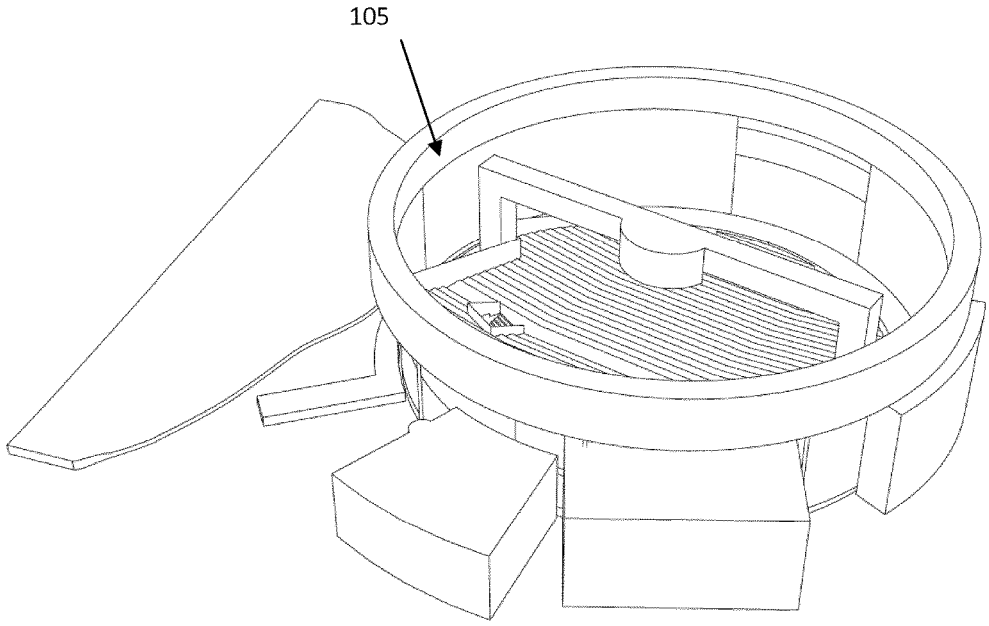
FIGS. 1G and 1H show an exemplary theatre configuration to provide a close-up view of a scene.
Figure 1H:
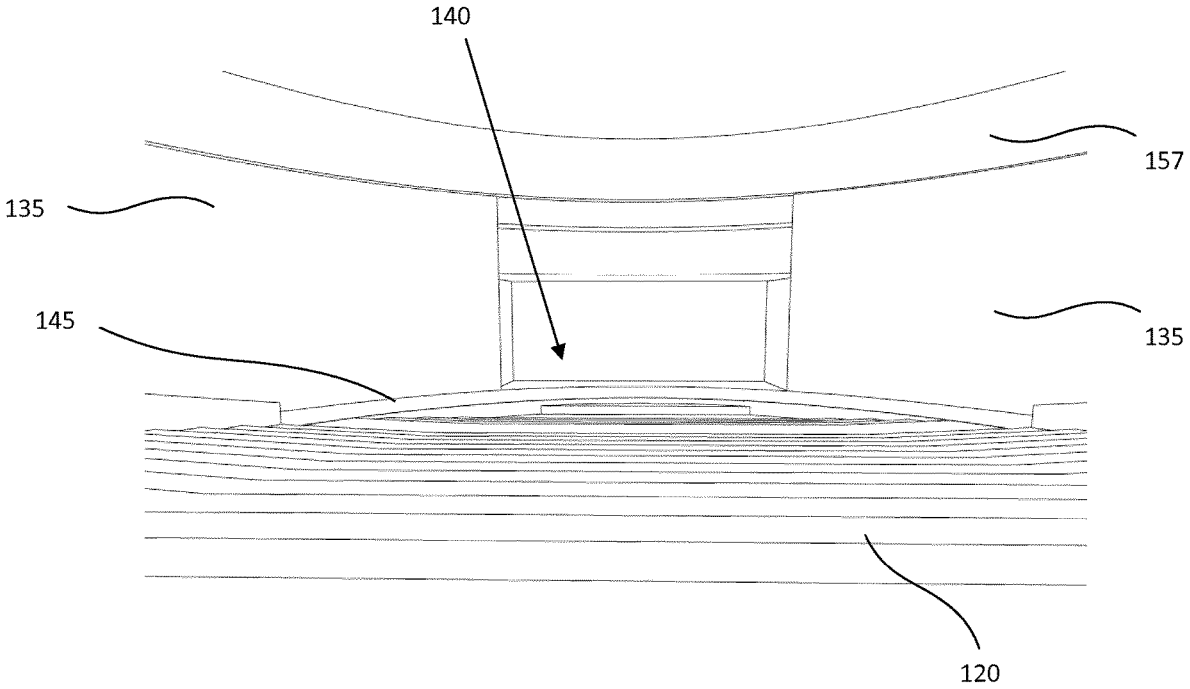

For example, the drum 105 may be configured according to FIG. 1E and the audience may have the wide-screen view depicted in FIG. 1F, where the scene 140 is framed by the screens 135 and masking 157 which hides the round truss 134. At the end of this scene, the screens 135 can be brought together and the drum 105 can be reconfigured to that shown in FIG. 1G. When the screens 135 are separated, the audience can be presented with a scene 140 such as the close-up scene shown in FIG. 1H. The flexibility offered by the current system is not possible in existing theatres. Isolating the audience from any visual or audio cues means they are not able to locate themselves during the rotation of the seating area 120 and are therefore unable to work out with what type of scene 140, wide-angled, close-up, etc., they should expect to be presented. This allows stage crews to change the scenery of a set 140 during the production, so that even if the drum 105 were to return to a previous configuration, the audience would have no way of knowing whether or not it was a scene 140 they had previously seen. By incorporating multiple screens 135, it is also possible to create a live split-screen effect for the audience. Previously, such an effect would have been created by having two people standing apart on a stage with different or no lighting, different sets or possibly a thin screen between them. The present system significantly improves on this, as completely independent scenes can be used in parallel to provide a considerably more engaging performance. The combination of multiple screens 135 and a revolving seating area 120 means that the transition time between scene changes is considerably shorter than in traditional theatres, as the audience does not have to wait for sets to be moved on and off the stage before raising the curtain and continuing the production. The present system can simply present a new set or scene 140 by rotating the seating area 120 to face another direction and presenting the audience with a new scene that was prepared in advance or during a scene involving a different set. Further the sets 140 of the present theatre construction can be made more realistic or incorporate features not previously possible, such as a lake or pool, as there is no need to remove any given set in order to free the stage area for a different set 140. Furthermore, as there is a reduced need to change sets 140 between scenes, fewer technicians are required during the performance.

In addition to the faster transition time between scenes, several high definition projectors are located on the bridge 125 which can project additional scenes onto the screens wherever they are located around the drum 105. In the example shown, the present system can incorporate four, six or even ten projectors. This provides a particularly efficient way of enhancing the theatrical performances by combining cinematic scenes. As the four screens 135 provide a continuous projecting surface that spans more than 180 degrees of the audience's field of view, they can be used to create complete panoramic scenes in which to immerse the audience. Combining such cinematic experiences in a theatre production can provide truly novel experiences for the audience. Each of the separate systems that enable this are discussed below and with reference to the appended Figures.

Circular Support Structure and Screens

Figure 8A:
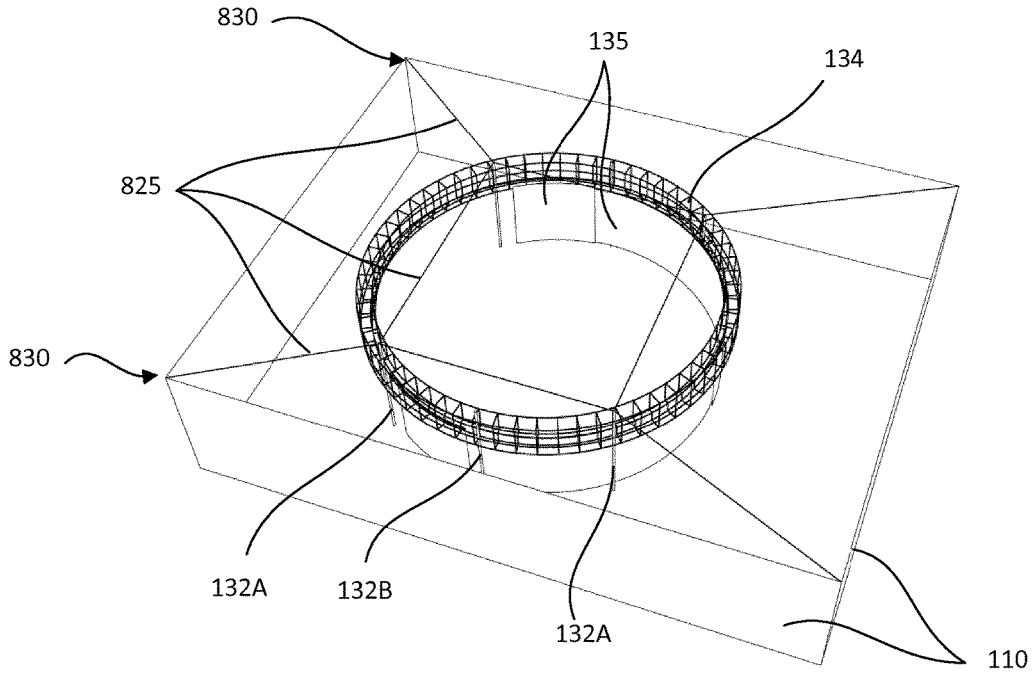
FIG. 8A shows a perspective view of the cable tensioning system used to secure the round truss structure.
Figure 8B:
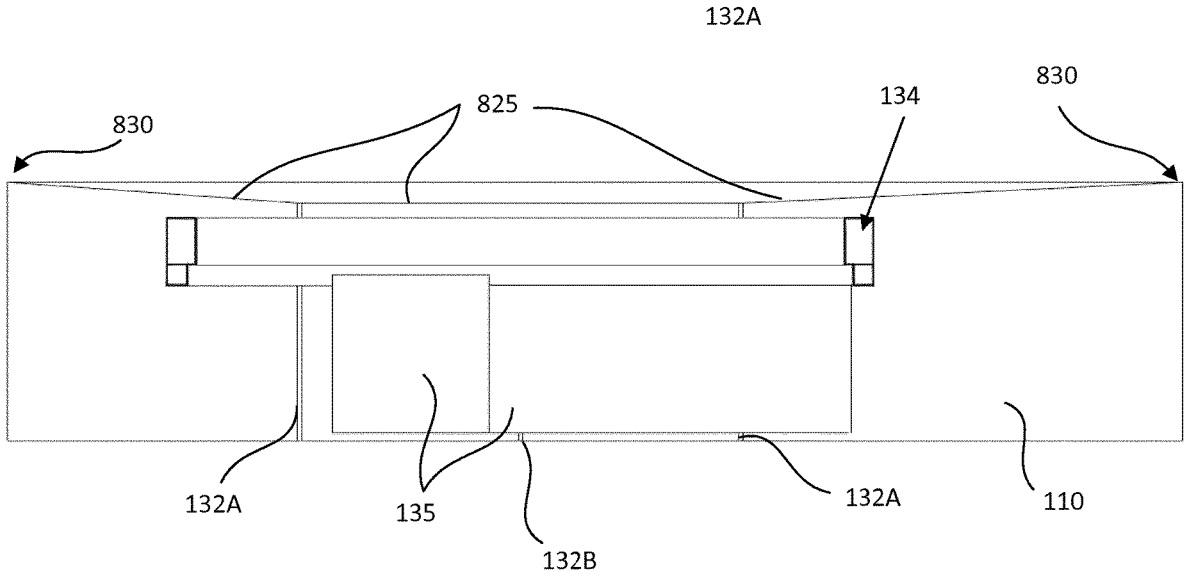
FIG. 8B shows a side section view of the cable tensioning system used to secure the round truss structure.

The circular support structure 130 is best illustrated in FIG. 8A which shows a perspective view of the circular support structure. The use of the term "truss" herein is not intended to imply any limitation on the construction of the round truss structure. Typically, for reasons of weight, a framework structure of struts forming the truss is convenient. However, other constructions may be used. One of the main design considerations for the circular support structure 130 is the need to create a low cost structure that can be installed quickly into a space. To achieve this, it is desirable to have the round truss 134 supported from the ground rather than the ceiling, as it would take considerable cost to ensure the fabric of the building is capable of withstanding the loads of the fully loaded round truss 134, although such a ceiling-mounted construction is feasible. Therefore, the circular support structure 130 is formed of a round truss 134 raised above the audience and held in place by multiple support poles 132. A series of motors (not shown) attached to each of the support poles 132 can be used to raise the round truss 134 vertically into the correct position before the support structure 130 is secured in position. Six support poles 132 are shown in FIG. 8A, but more or fewer than six poles may be used to support the round truss 134. The round truss 134 may be used to contain some of the lighting and audio equipment necessary for the performance, and the round truss 134 is typically shrouded in masking 157 to conceal any equipment and the round truss 134 itself from the audience below. Arranged in this manner, the round truss 134 is subjected to significant loads, primarily its own weight and the weight of any equipment attached, and would bend in normal use. To substantially prevent rocking or any unwanted deformations during operation the circular support structure 130 is stabilised by a cabling system which connects the support poles 132A to the walls of the theatre building via a series of cables 825 which are anchored to the wall at multiple anchoring points 830 (see also FIG. 8B). This enables the circular support structure 130 to be secured to the walls 110 of the building 100 and stabilises the structure 130 during operation of the revolving seating area 120 and moveable screens 135. Such an arrangement would also secure the drum 105 and circular support structure 130 in the event of earthquakes or tremors which might otherwise cause significant damage to the theatre 100. By avoiding use of the roof to secure the circular support structure 130, the present system does not have as many structural regulations to comply with, which means the types of spaces in which the present theatre can be installed is greater than a theatre requiring equipment or supports connected to the roof. This provides greater flexibility with regard to the kind of locations and types of buildings that could be used to host a theatrical performance. Compared to existing theatre buildings, the present system can be installed within a warehouse specifically built for the theatre construction. Such a structure is relatively quick and cheap to construct compared to traditional theatre buildings. While it is desirable not to stabilise or support the present theatre construction from the roof of a building, it is conceivable that this is possible, where the roof is sufficiently strong. In this case, the round truss 134 would be supported by structures from the roof of the building rather than from the ground by the support poles 132.

Figure 9A:
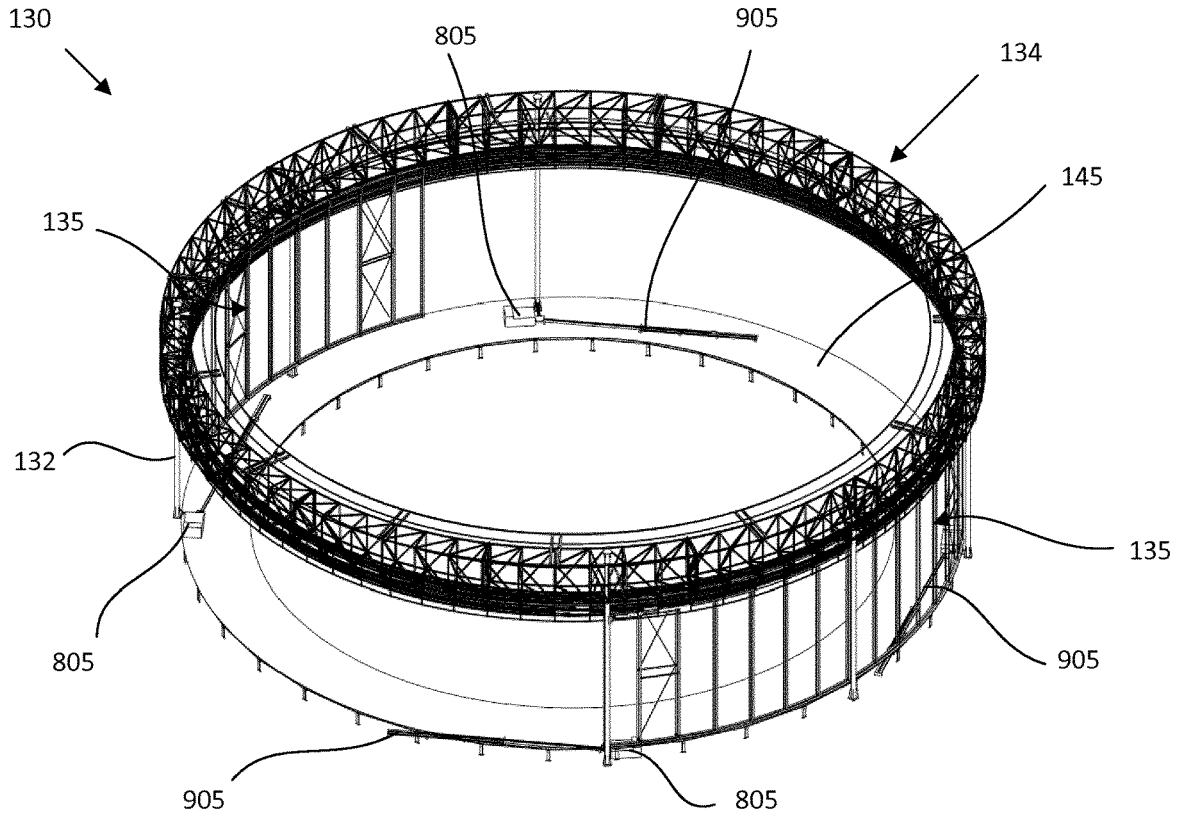
FIG. 9A shows a perspective view of the circular truss structure with screen motors located under the annular structure.
Figure 9B:
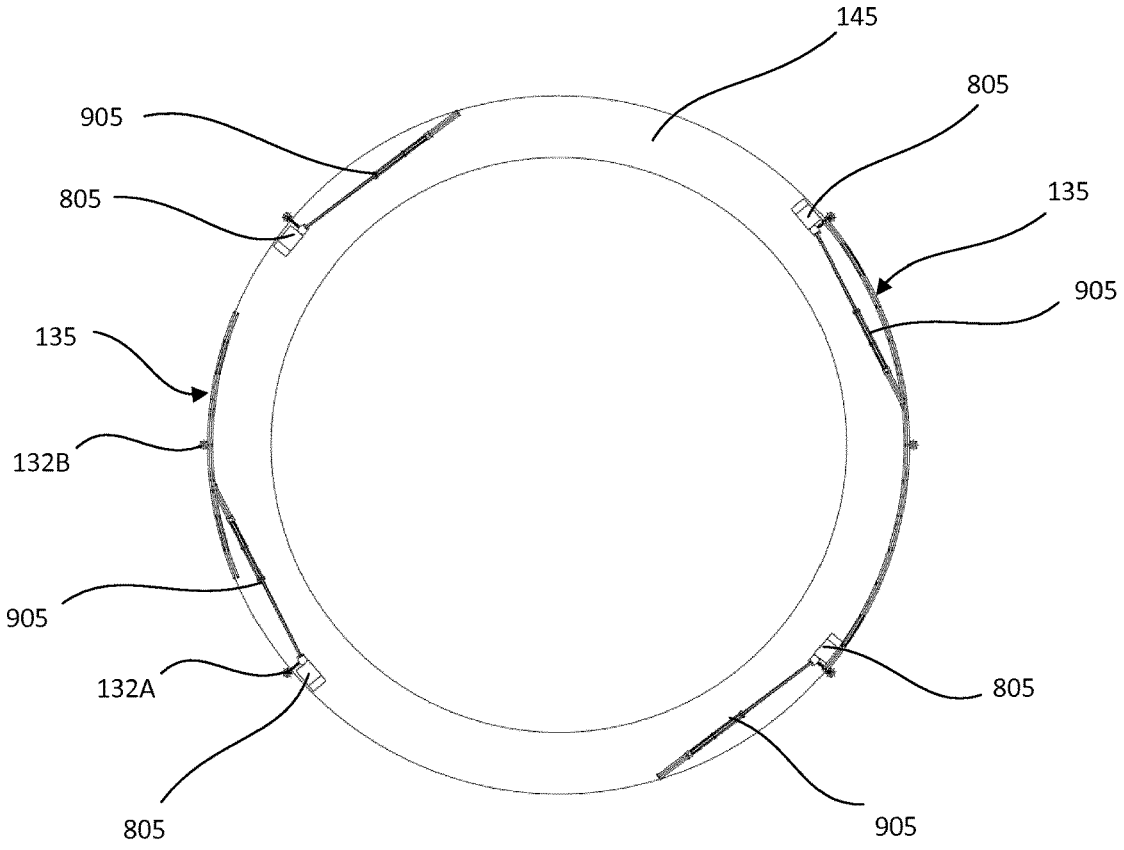
FIG. 9B shows a plan view of the arrangement of FIG. 9A.

FIG. 9A shows a perspective view of the circular truss structure with screen motors located under the annular floor structure. Locating the screen motors 805 under the annular flooring 145 is preferable to locating the motors 805 in the round truss 134 above the audience, as the noise of the motors can be further separated from the audience to enhance the performance experience. Locating the motors 805 at the base of the support poles 132 is also more reliable and easier to maintain, as there is no need to elevate maintenance personnel to the top of the support pole 132. As shown, the screens 135 are located around the periphery of the annular floor 145 and hang from rails that travel the circumference of the round truss 134. The rail contains a series of wheels (not shown) to reduce the energy required to move the screens in addition to providing a near-silent way of moving the screens 135 around the rail. It should be noted that two of the screens have been omitted for clarity in FIG. 9A. Each screen 135 is driven by a respective motor 805 which pulls a loop of steel cable 915 that runs around the circumference of the rails and grips the screen 135. The steel cable 915 is held in tension by the pulley system shown in FIG. 9C. By keeping the cable 915 in tension, it is possible to rely only on the friction generated between the screen 135 and the steel cable 915 to pull the screen in a counter clockwise or clockwise direction. As the steel cable is an endless loop and the screens 135 are driven by friction between their steel cable 915 and the screen, an individual screen 135 can travel around the entire circumference of the round truss 134 continuously without restriction from the steel cable 915. That is to say, all screens 135 are effectively able to travel endlessly around the drum 105. While four screens 135 are preferably shown in the Figures, more or fewer than four screens may be used depending on the requirements of the creative director. The present theatre system uses four screens 135, as it is able to provide the creative director with a significant amount of flexibility in how the performance can be executed without incurring significant technical problems associated with increasing the number of moveable screens.

Figure 9C:
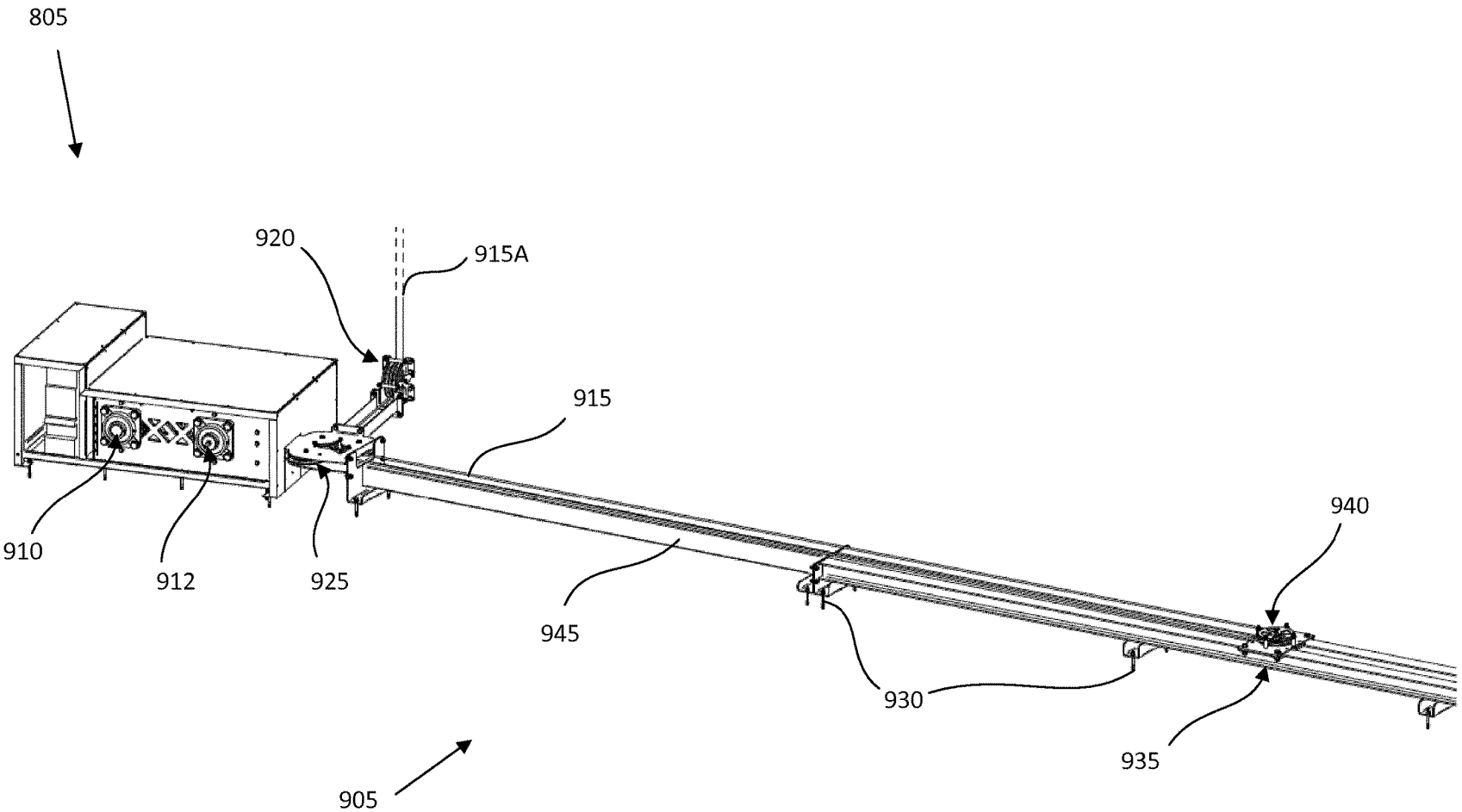
FIG. 9C shows a perspective view of the fireproof motor housing and pulley system used to move the screens.

FIG. 9C shows a perspective view of the motor and pulley system used to move the screens. Each screen 135 has its own cable and pulley system to drive each screen 135 independently of one another. This system comprises a tensioning system 905 to keep tension in the steel cable 915 during operation. The cable tensioning system 905 comprises a sliding track 935 anchored to the ground by a series of anchors 930. A tensioning pulley 940 is mounted to the sliding track 935 which may also comprise an extendable section 945. The tensioning system 905 is used to maintain the steel cable 915 under tension so that sufficient friction can be generated to move the screens. However, there is a risk that keeping the steel cable 915 constantly under tension will cause the cable 915 to creep and elongate over time. If this happens, the tension in the cable 915 will decrease and the screens will not be gripped sufficiently by the cable 915, resulting in the cable 915 "slipping" over the screen 135 instead of driving the screen 135 in a controlled manner. The screens 135 will no longer be able to be positioned accurately when the cable 915 slips, as the forces due to the acceleration and deceleration of the screens 135 will be greater than the frictional force between the cable and the screens 135. To prevent this, it is possible to move the tensioning pulley 940 along the rail 935 so that sufficient tension can be maintained in the cable 915 to grip the screen 135. A further measure to enhance the grip of the cable 915 is to provide a high friction surface, such as an elastomer, between the cable 915 and the screen 135. One way of achieving this is to include a rubberized surface of the screen 135 that would come into contact with the cable 915.

With the steel cable 915 under sufficient tension, the motor 805 can be used to pull the cable 915 to move the screen 135 in a clockwise or counter clockwise direction. The steel cable 915 runs from a torque coupler 910 of the motor 805 through the cable tensioning system 905, through pulley system 925 and through pulley 920. Pulley system 920 is located at the base of a support pole 132 so the steel cable 915 can be fed up the support pole 132 to a further pulley system 947 mounted in the round truss 134 which redirects the rising cable section 915A around the circumference of the rail 1035 before returning to the pulley system in the round truss 134 which directs the cable 915 down the support pole 132 to pulley 920 and back to the motor 805. The motor 805 also contains a non-driven axle 912 which is not powered, but prevents the cable 915 being accidentally unwound beyond its limits. The motor 805 may be a servo motor.

The electrical connections that operate the screens 135 are run through a channel in the support poles 132 of the circular support structure 130, so they remain hidden from view of the audience.

The arrangement of the circular support structure 130 results in some of the support poles 132A being in compression and others 132B being in tension. This is due to the weight of the round truss 134 and any sound or lighting equipment attached to the round truss 134. As load is applied over the unsupported parts of the poles, this will cause the structure 134 to deform and "sag". Typically, this would be in the order of 50-80 mm. This amount of displacement of the truss structure 134 would create a light gap under the screens 135 which would allow the audience to orientate themselves. However, by distributing a series of counterweights 1050 (see FIG. 10E) around the periphery of the round truss 134 on the same rails on which the screens 135 are mounted, the deformation of the round truss 134 remains substantially constant during operation of the screen 135, which eliminates the problem of a light gap under the screens 135. The round truss 134 effectively remains in the same pre-stressed state regardless of the position of the screens 135. The support poles 132B that are in tension, limit the amount of overall deflection in the support structure 130. This can be seen in FIG. 10C which shows a side view of a screen mounted to a rail. The screen 135 is shown mounted to a rail 1035 with multiple brackets 1040. The brackets may be used to secure the screen 135 to the rail or a counterweight to the rail 1035. Therefore, as the screens 135 moves around the drum 105, the counterweights are pushed around by the screens and the round truss 134 effectively remains in a pre-stressed state and does not deflect noticeably during operation of the screens 135.

Figure 10A:
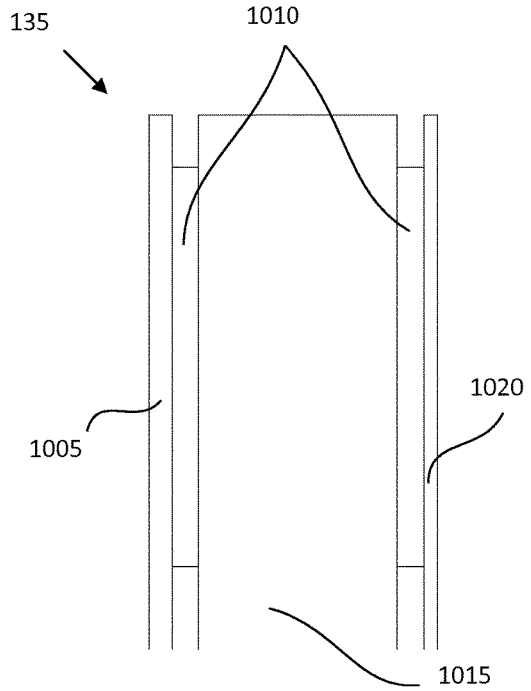
FIG. 10A shows a cross section view of the screen.
Figure 10B:
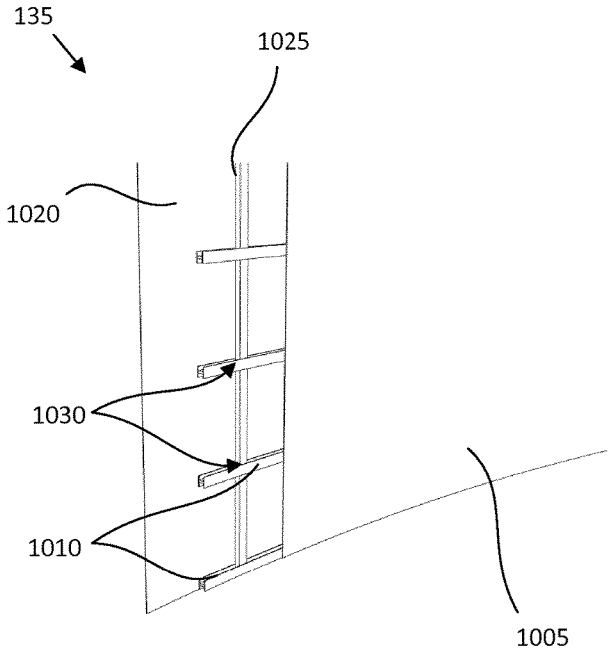
FIG. 10B shows a perspective view of the support structure of the screen.
Figure 10C:
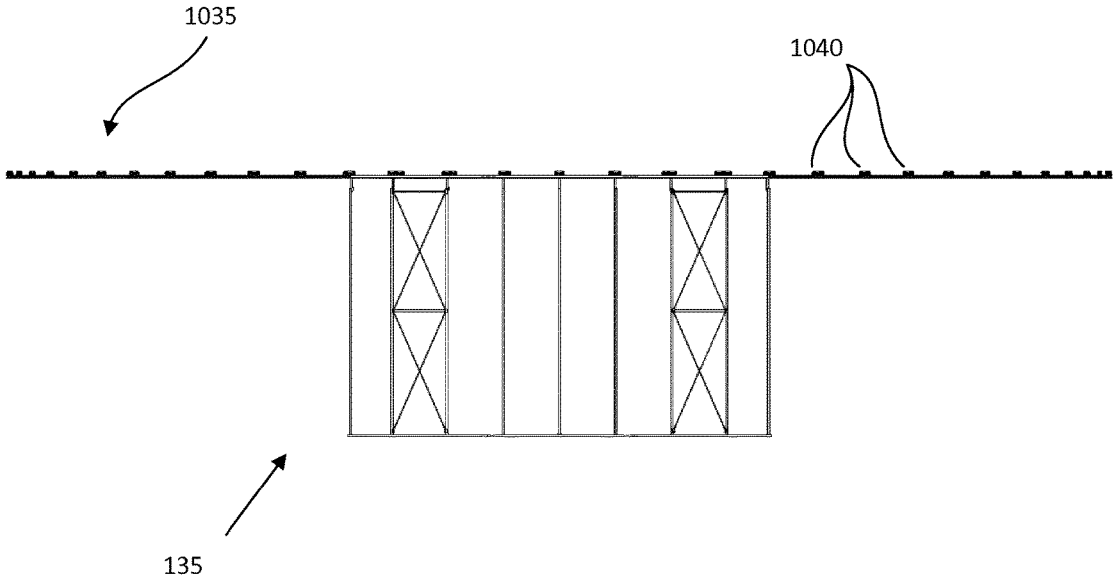
FIG. 10C shows a side view of a screen mounted to a rail.
Figure 10D:
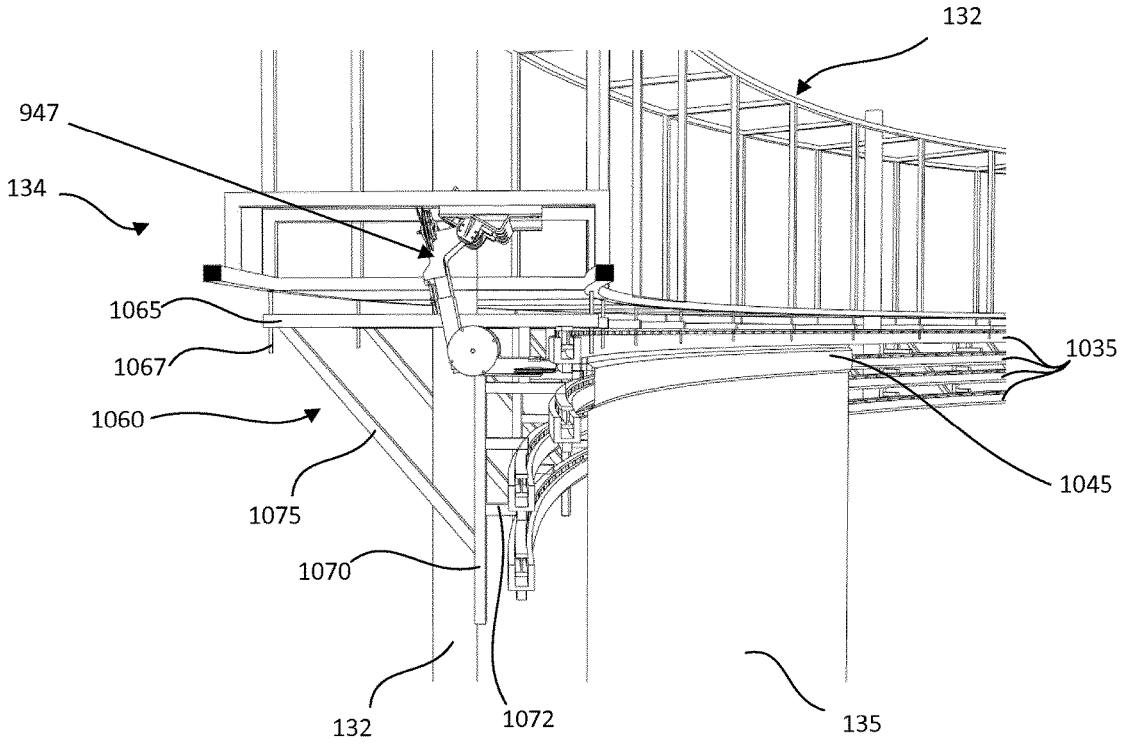
FIG. 10D shows a side view of a screen mounted to a rail attached to the truss structure.
Figure 10E:
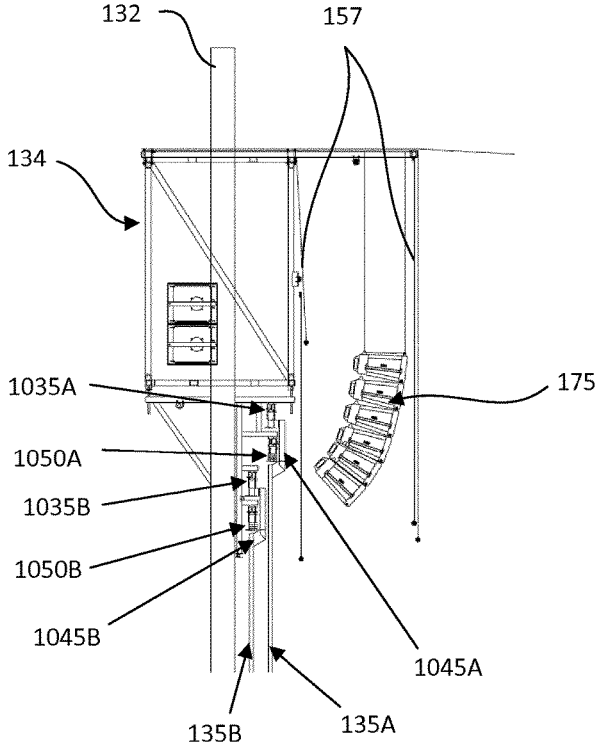
FIGS. 10E and 10F show different rail arrangements.
Figure 10F:
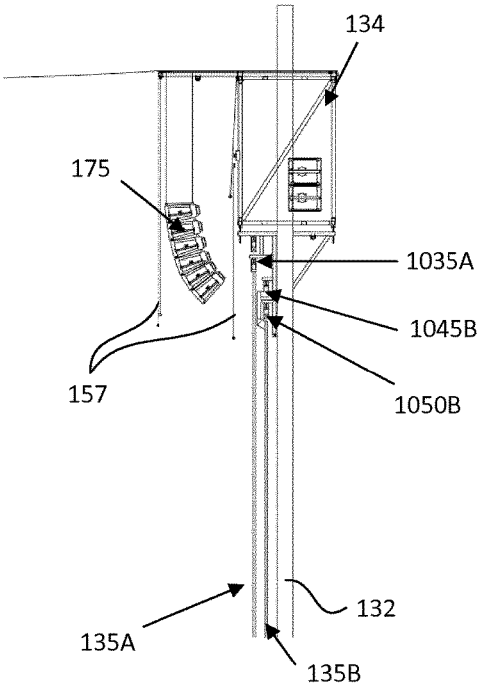

The arrangement of the rails is best illustrated in FIGS. 10D-10F. FIG. 10D shows a side view of a screen mounted to a rail attached to the support structure 130. Each screen 135 is attached to a rail 1035 by a hanger 1045 and each rail 1035 is secured to the round truss 134. The rail 1035 is secured to the round truss 134 by a series of A-frames 1060. For example, 72 A-frames 1060 may be used to support the four rails 1035 attached to the round truss 134. An A-frame 1060 comprises a horizontal support 1065 connected to a vertical support 1070 and a cross member 1075 connected to the horizontal support 1065 and the vertical support 1070. The horizontal support 1065 is connected to the round truss 134 by a series of bolts 1067. The vertical support 1070 is connected to each rail by a respective cantilever strut 1072. The other end of the cantilever strut 1072 is connected to a circular I-beam which is housed within a bearing. The bearing may be a roller bearing chassis. The bearing chassis and I-beam arrangement form the rail 1035 from which each screen 135 is suspended. Once the circular support structure 130 is installed, the round truss 134 will have considerable amounts of lighting and audio equipment distributed around its circumference. This is in addition to the weight of the screens 135 and counterweights 1050 also located around the round truss 134. The uneven loads exerted on the round truss 134 can cause deformation of the shape of the round truss 134. The result of this is the screens 135 would not run horizontally and a light gap may be created at certain screen positions. By using a plurality of bolts 1067 to secure the A-frame 1060 to the round truss 134, it is possible to adjust the orientation of each A-frame 1060 to account for the additional loads, such that the screens 135 will run substantially horizontally around the circumference of the round truss 134 with a minimal light gap at the base of the screens 135. In the example shown, two bolts 1067 are used.

The rails arrangement shown in FIG. 10E is the presently preferred arrangement for the present theatre system and provides greater functionality over other rail arrangements. In particular, this arrangement allows independent movement of all four screens 135. Suspending four screens 135 from four rails 1035 offset radially from one another would create large gaps between screens which would produce a poor quality experience for the audience, because the screens 135 closest to the audience would potentially cast larger shadows on the screens 135 behind them. Further, the innermost rails would produce significant torque on the round truss 134 due to the increased distance between the round truss 134 and the rail 1035. This would result in the truss being subject to significant stresses and potentially reduce the lifespan of the structure. If four rails were stacked vertically above one another to prevent casting of shadows, this would not provide any ability to have screens 135 pass one another. Further, mounting multiple screens 135 on a single rail 1035 would not provide independent screen movement, as the portion of the rail not used to suspend a screen 135 contains counterweights 1050 to prevent the round truss 134 from deflecting noticeably during screen operation. The counterweights 1050 are pushed around the rail 1035 by the suspended screen 135 and therefore, any additional screens 135 mounted to the same rail would be driven in the same manner. The present arrangement allows independent movement of all four screens 135 with no additional sagging of the truss structure 134, while ensuring pairs of inner and outer screens 135 can pass over each other.

FIG. 10E shows a side section view of a plurality of screens each attached to a different rail. As shown in the Figure, a pair of inner rails and a pair of outer rails are mounted to the A-frame 1060. An upper inner rail 1035A is connected to a hanger 1045A which is used to support inner screen 135A. The hanger 1045A is C-shaped so that it can pass around a rail located directly below the first inner rail 1035A. A screen 135 is also suspended from the lower rail and counterweights 1050 are distributed along the lower rail. This pair of inner screens 135 are able to move independently of one another due to independent cable and pulley loop drive systems. Each loop drive system is located at the base of a support pole 132. As the inner screens 135 are substantially co-planar, it is not possible for the screen 135 suspended from the upper inner rail 1035A to cross over the screen 135 suspended from the lower inner rail. In addition to the pair of inner screens, there are also a pair of outer screens 135 suspended from the outer rails. The upper outer rail 1035B and lower outer rail are arranged in a similar manner to the pair of inner rails. A screen 135 is suspended from each outer rail and includes a series of counterweights distributed around the circumference of each rail. Each outer screen is also driven by an independent loop drive system, which allows for independent screen movement. It should be noted that the inner rails are mounted above the outer rails, as the loop drive system needs access to the outer face of the rails, which is run horizontally from the pulley system 947. This is the preferred arrangement, as this minimises the amount of exposed cable 915 in the round truss 134. The arrangement of rails as shown in FIG. 10E is particularly advantageous over a simple series layout where four rails are offset from each other in the vertical or radial direction, as it allows the outer screens 135 to pass over the inner screens. As the radial offset between inner and outer screens is small, approximately 20 cm, inner and outer screens can be layered directly on top of one another without significant shadowing which further reduces the light gap and improves the immersive nature of the performance. The stacked rail arrangement shown in FIG. 10D enables pairs of co-planar screens to be driven independently of one another and provides the ability to pass in front of one another. The loop drive system enables the pairs of screens 135 to be driven continuously in a single direction if desired. It is possible to suspend the two large screens and two small screens in any combination between the inner and outer rails. For example, the inner pair of screens may be small screens, while the outer pair of screens are large screens. Similarly, the inner pair of screens may comprise one large screen and one small screen and the outer pair of screens may comprise one large screen and one small screen.

An inner counterweight 1050A is located on a second rail directly below the first inner rail 1035A supporting the inner screen 135A. An outer screen 135B is also shown connected to an outer rail 1035B by an outer upper hanger 1045B. By channeling the counterweights 1050B attached to an outer upper rail through the space created by hanger 1045B, the outer lower rail with counterweights 1050B can pass within the internal space of the upper rail 1035B. By allowing the counterweights 1050 to pass within the internal space of the hangers 1045, lower rails with counterweights 1050 can move independently of the screens 135 attached to the upper rails 1035A, 1035B. In some screen configurations, there may only be counterweights located at certain positions around the round truss 134.

When screens 135 are layered in this manner, it is important that the screens 135 do not collide as they pass by one another or when they are placed immediately next to one another. To aid this, the screens 135 have tapered ends such that, when screens 135 are brought adjacent to one another, it is not readily discernible that there are two separate screens. This also ensures that when screens 135 are next to one another, there is no need to leave a large gap between screens to prevent the screens from clashing which would potentially allow light to reach the drum 105. This ensures the audience are not able to orientate themselves throughout the performance regardless of how the screens are configured.

Various arrangements of rails are compatible with the present theatre system. In all arrangements, masking 157 is used to conceal the rails 1035 from the audience to enhance the performance. An exemplary arrangement is shown in FIG. 10F, where an outer screen 135B, similar to screen 135B of FIG. 10E, is provided in combination with an inner screen 135A which does not have a C-shaped hanger and is thus able to be hung closer to the outer screen 135B. Hanging screens with simple straight hangers is encompassed by this description, as there may be cases where it is not necessary to have rails passing within the space of a hanger.

Figure 10G:
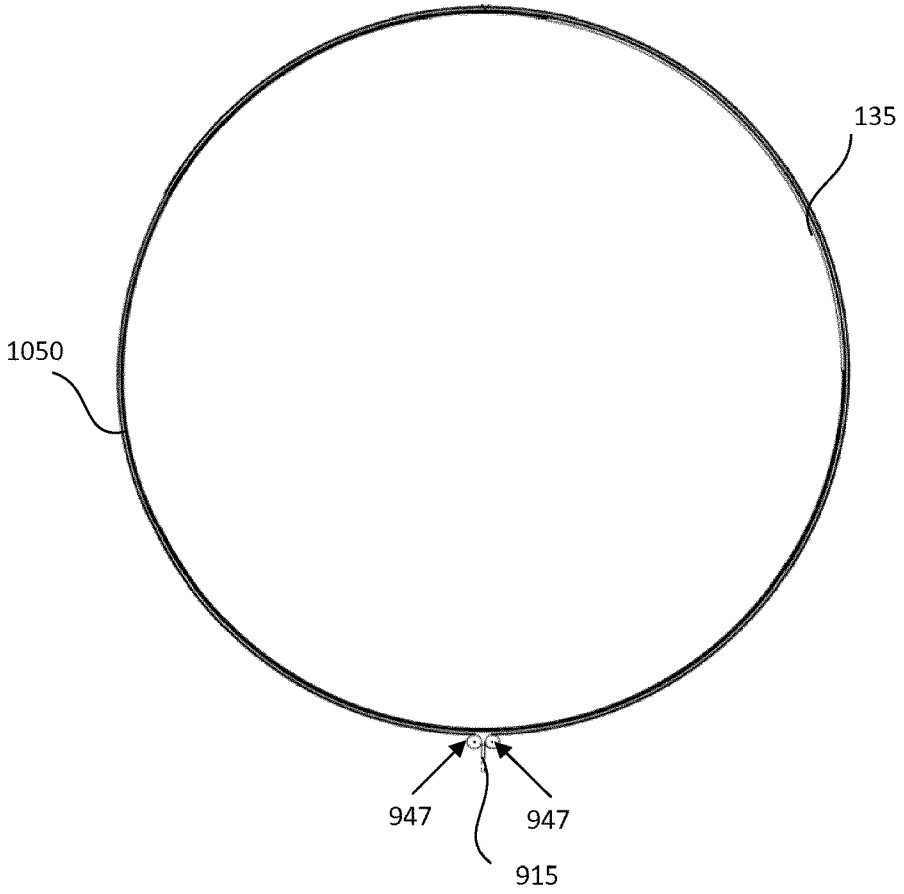
FIGS. 10G and 10H show plan views of the cable and pulley system used to move the screen along a rail.
Figure 10H:
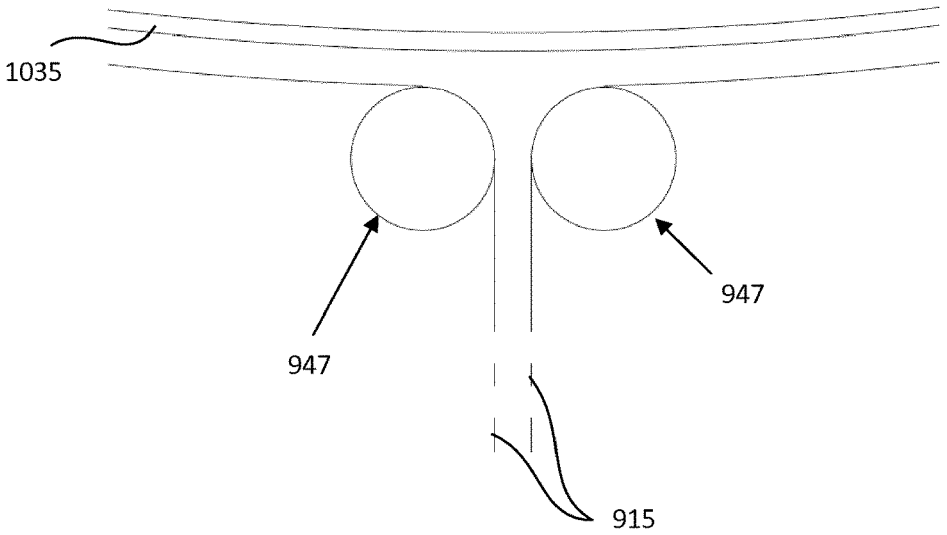

FIGS. 10G and 10H show a plan view of the cable and pulley system used to actuate a screen. Pulley system 947 is secured to the round truss 134 and receives the cable section 915A fed from the base of the support pole 132 (not shown). The steel cable 915 used to move the screen passes through the pulley system 947 and to an outer rail 1035 to grip and pull the screen around the rail 1035. As the motor pulls the cable 915, the screen will rotate in a clockwise or a counter-clockwise direction.

FIG. 10A shows a cross section view of the screen. Each screen 135 is formed of a layered structure and comprises a layer of KAPA mount board 1005, a layer of plywood 1010, a layer of steel 1015, a further layer of plywood 1010 and a layer of fire retardant black cloth 1020. KAPA mount board is a proprietary polyurethane foam board laminated between aluminium sheets and has excellent fire retardant properties. The multiple plywood layers 1010 are a result of using plywood shaped as I-beams to assemble the screen structure. This creates a smooth, hard, lightweight and fire-resistant curtain. While it is preferable to have screens formed of a fire-retardant foam board sandwiched between aluminium layers, it is conceivable that only one side of the screen may have an aluminium covering. FIG. 10B shows a perspective view of the support structure of the screen. An aluminium frame 1025 provides the main support structure for the screens 135. As shown, the plywood layer 1010 is a sandwich panel and is screwed to the aluminium frame 1025 at several connection points 1030 distributed across the aluminium frame 1025. The plywood layer 1010 is used to create the curvature of the screen 135. The KAPA mount layer 1005 is glued and screwed or stapled to the plywood 1010. In the event of a fire, the mechanical fixation securing the fire-retardant KAPA mount layer 1005 to the aluminium frame 1025 ensures the screen does not catch fire. A layer of fire-retardant black cloth 1020 secured to the outside of the screen acts as a barrier to light reaching the drum 105 or reflecting to the stage, as well as providing a fire-retardant layer.

The KAPA mount board 1005 is flat originally and needs to be attached to the plywood layer 1010 to create a curved fire-retardant surface. It is the plywood I-beam 1010 that is able to be bent into the correct configuration, such that the screens have the correct radius of curvature to match the curvature of the rails mounted under the round truss 134.

To avoid the screens 135 casting shadows on one another, for example when one screen is partially in front of another screen or when projecting onto a continuous curved surface created by multiple screens 135 arranged next to one another, the edges of the screen can be tapered to reduce the shadows that would be cast due to the projections or lighting. The ability of the present screens 135 to act both as a light-blocking mechanism, as well as being a projection surface that is fire-retardant is a particularly elegant solution to the problem of fire safety and projecting onto a curved surface.

Seating Configuration and Rotating Seating Area

Figure 2A:
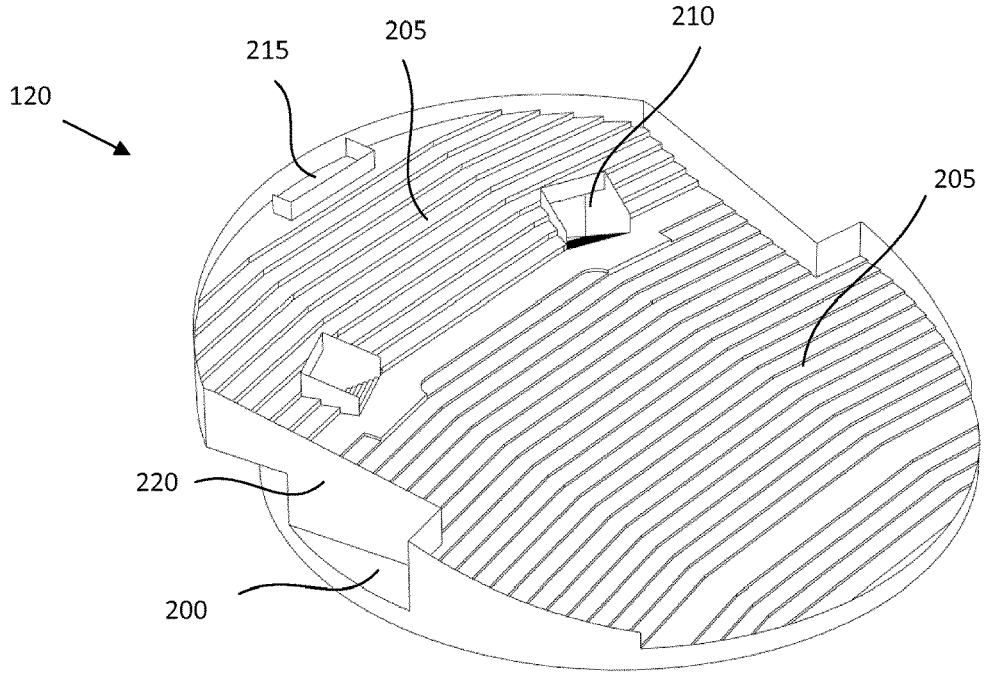
FIG. 2A shows a perspective view of the seating area of the theatre incorporating an overhanging rear seating portion.
Figure 2B:
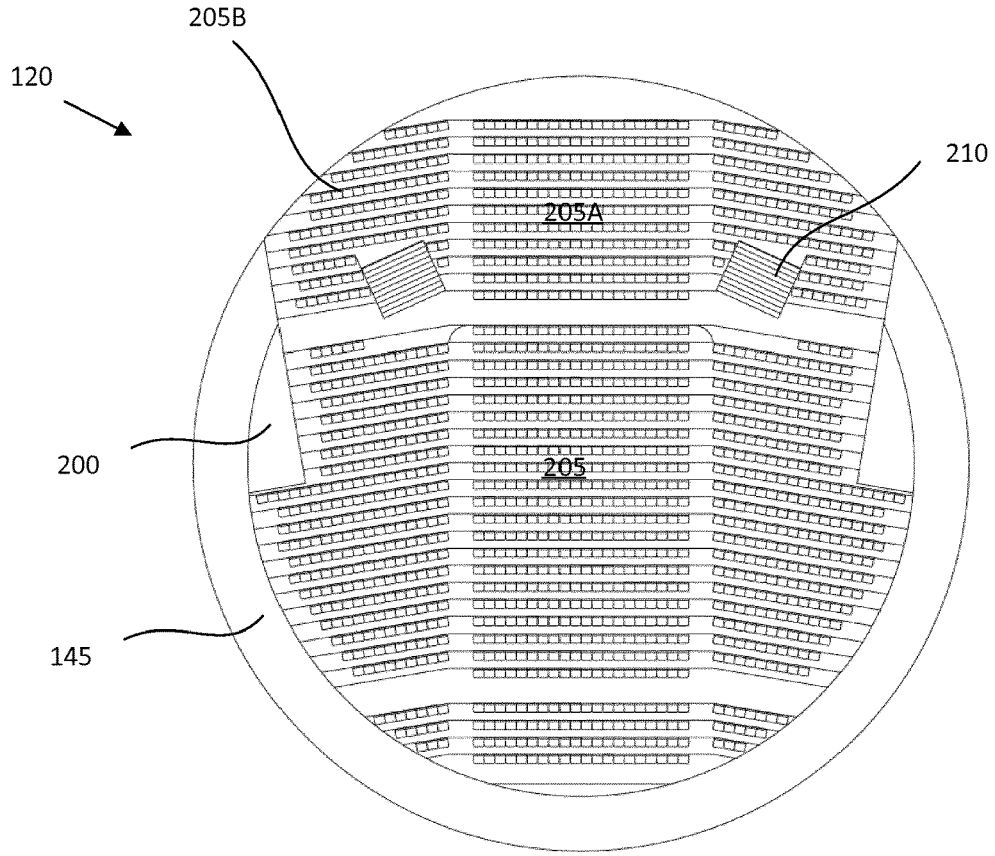
FIG. 2B shows a plan view of the seating area highlighting the additional seating capacity provided by the overhanging rear seating portion.

To successfully operate a theatre company, it is essential to ensure sufficient seating is provided, so each performance can be viewed by sufficient numbers of people while complying with the relevant regulatory regulations that may be in place. FIG. 2A shows a perspective view of the seating area of the auditorium. The seating area 120 is shown with a floor area 200, seats 205, entrances 210, an audio and/or lighting operator box 215 and side walls 220 to prevent audience members falling onto the annular floor below (not shown). As best shown in FIG. 2B, the nature of raked seating means there is inherently space below the seats farthest back from the stage. As the annular floor 145 runs around the seating area floor 200, there will always be a part of the annular floor 145 that is not being used for the performance as it will be located behind the audience.

Figure 2C:
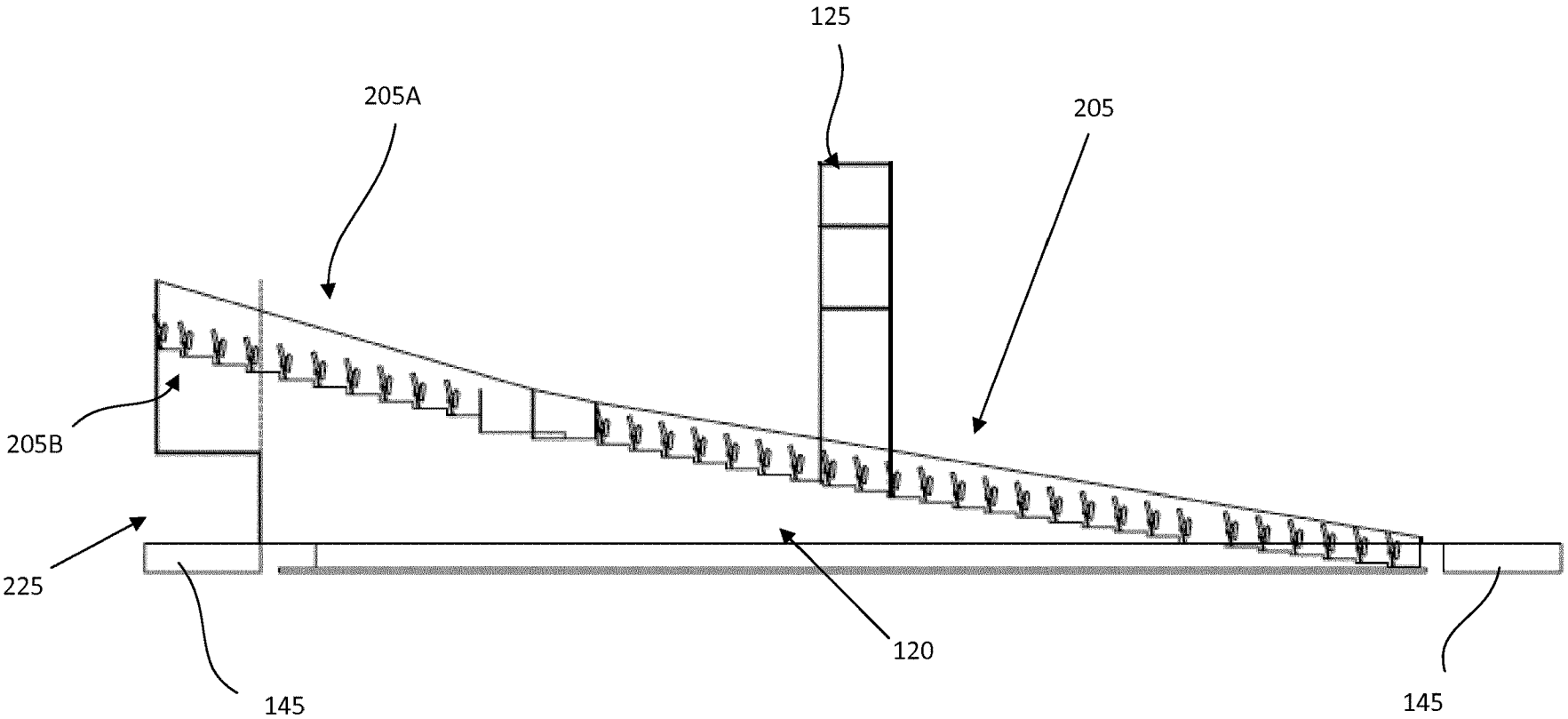
FIG. 2C shows a side section view of the seating area showing the overhang region below the rear seating area.

Therefore, there is an opportunity with a revolving auditorium 105 to exploit this, by extending the seating 205 such that there is seating 205A located over the floor 200 of the seating area and additional seating 205B that is located over the annular. The additional overhang seating 205B allows a theatre company to increase their revenue from each performance without having to increase any additional structures of the theatre. This is a particularly efficient use of the space constraints that exist within theatre buildings. Depending on the nature of the performance, the seating area 120 may be considered a general audience area, where people are standing instead of sitting. In some cases there may be a mix of standing and seating areas. In other cases, the audience area 120 may not be raked and may be substantially flat or horizontal FIG. 2C shows a side section view of the seating area showing the overhang region below the rear seating area. Even though there is no performance taking place on the annular floor 145 under the overhang 225, the overhang area 225 itself may be high enough for an adult to walk through and for stage crew to perform any work needed for the performance. The overhang 225 may cover a portion of the annular floor 145 directly under the rear portion 205B of the seating area 120, such as shown in the Figure. Alternatively, the seating floor area 200 may permanently cover a portion of the annular floor 145. The overhang 225 may cover at least a half or a third of the width of the annular floor 145. The overhanging area may provide standing room for audience members. This may be in addition to seating provided in the overhanging seating area 205B.

Figure 3:
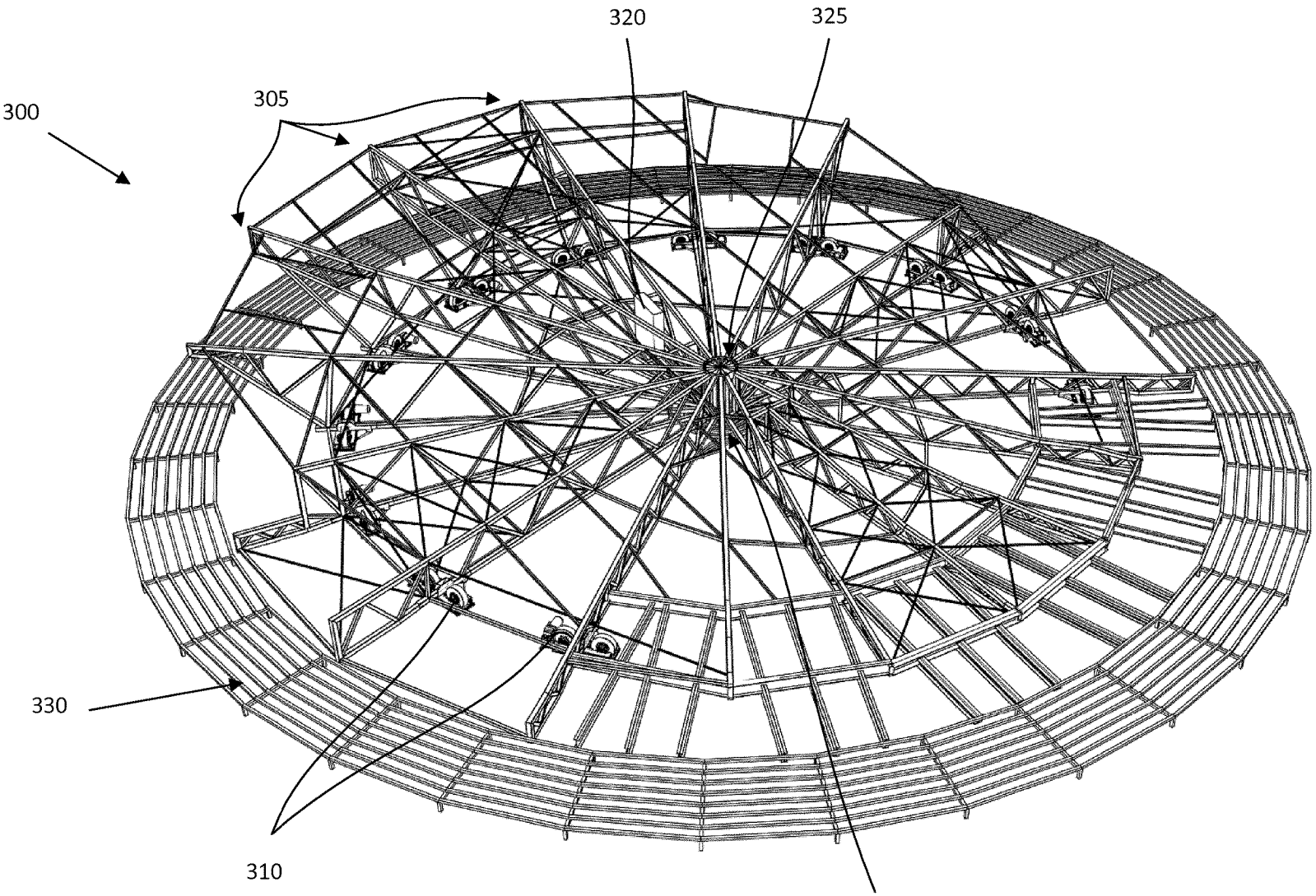
FIG. 3 shows a perspective view of the seating area chassis and the annular support structure.

FIG. 3 shows a perspective view of the seating area chassis. The revolving seating area 120 is mounted on a chassis 300 which is anchored to an anchoring plate 500 buried in the ground and able to rotate due to a central bearing located in the centre of the chassis 300. The chassis 300 is formed of multiple spokes 305 that radiate from a central hub 325. The spokes 305 have interconnecting members that connect multiple spokes 305 which further strengthens the chassis 300. The chassis 300 is driven by multiple motorized bogies 310 attached around the periphery of the chassis 300. The motorized bogies are formed of a servo motor connected to a drive wheel which is connected by a connecting member to a freely rotating wheel. As shown, there are seventeen bogies, each with two wheels. To account for the height of the present chassis 300 which is raised 70 cm off the ground and has a 30 m diameter, double bogies are used to support the chassis 300. This is considerably more effective than prior art rotating auditoriums.

Around the hub 325 there is a conductor or slipring 315 which channels the electrical connections that run from the theatre building to power any electrical equipment located in the chassis 300, on the bridge 125 or in the seating area 120, such as the audio/lighting operator box 215. The control equipment for the peripheral bogies 310 is located within a main automation cabinet 320 located within one of the spokes 305. The annular floor 145 described previously is mounted on a annular support structure 330 which is located around the edge of the chassis 300. The annular support structure 330 is not connected to the chassis 300. In order that the chassis 300 can rotate relative to the annular support structure 330, a gap is provided between the two structures. However, to substantially prevent any light from passing from below the chassis, where there may be lighting for stage crew and other equipment, into view of the audience, the inner edge of the annular support structure 330 and outer edge of the chassis 300 can be interleaved. This substantially prevents light entering the auditorium from below the chassis 300 while allowing the chassis 300 to rotate. Preferably, the annular support structure 330, and therefore the annular floor 145, are not motorized and do not rotate. However, in some cases it will be desirable to automate any of the annular support structure 330 or the annular floor 145 for rotation.

Power and Data Cable Management

One of the key design problems for a rotating seating area 120 which contains electrical equipment is the transfer of data and power from a static theatre building to a rotating chassis 300. If the cables were simply run from the theatre floor into the rotating chassis 300, the cables themselves would be subjected to a significant amount of tension and twisting which would cause mechanical damage to the cable. The present theatre system includes a number of features to overcome these issues.

Figure 4:
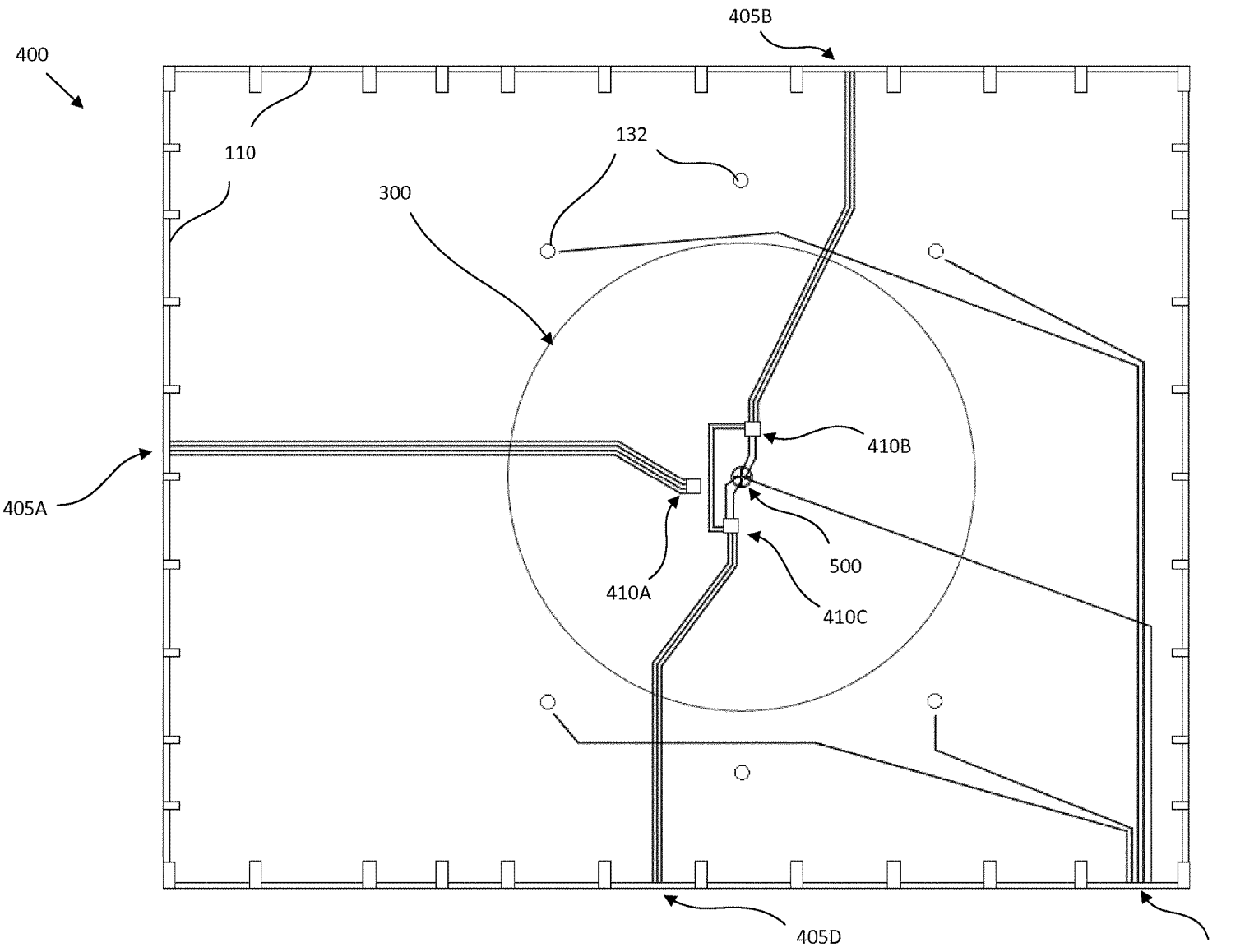
FIG. 4 shows a schematic layout for the electrical ducting for the theatre.

FIG. 4 shows a schematic layout 400 for the electrical ducting for the theatre. The exemplary layout shown, details how the electrical cables for each of the electrical systems are run between an anchoring plate 500 and a series of electrical cable access ports 405 in the theatre walls 110. The electrical cables are run from the access ports 405 to junction boxes 410 or directly to the anchoring plate 500 at the centre of the chassis 300 or the support poles 132. The cables that operate the automation systems 740 pass from access port 405C and are run to the support poles 132 to connect to the screen motors (not shown) located at the base of the support poles 132. Automation system cables 740 are also run between access port 405C and the anchoring plate 500. Cables to operate the lighting 730, video 735 and audio systems 750 are run from access port 405B to junction box 410B. The lighting 730 and audio 750 cables are also run between junction box 410A and 410C. The lighting cables 730 are also run with the video cables 735 to the anchoring plate 500. Electrical cables to operate the lighting 730, audio 750 and emergency lighting 745 systems are run from access port 405D to junction box 410C. From junction box 410C, the emergency lighting 745 and audio 750 cables are run to the anchoring plate 500.

As described above, power is provided to the chassis 300 through a conductor system 315. By having a series of conductors, different levels of power can be provided to meet the requirements of the different systems. As shown in FIG. 4, a series of electrical cables can be passed from access port 405A to a first junction box 410A. The junction box 405A can then be used to distribute power to the various systems of the theatre. For example, the motorized bogies 310 which rotate the chassis 300 are powered from a 400V, 200 A power supply with three-phase, neutral and earth connections, the lighting systems require a 125 A supply, the video and sound systems require a 63 A power supply, and the mains components of the chassis 300 and seating area 120 requires a 230V, 16 A power supply. Each of these can be supplied to a separate electrical track 570 to power the different systems of the theatre. Preferably this power supply is located near the central foundation of the chassis 300. The grounding point for the chassis power supply should be located near the central foundation where the chassis 300 is anchored.

Figure 5A:
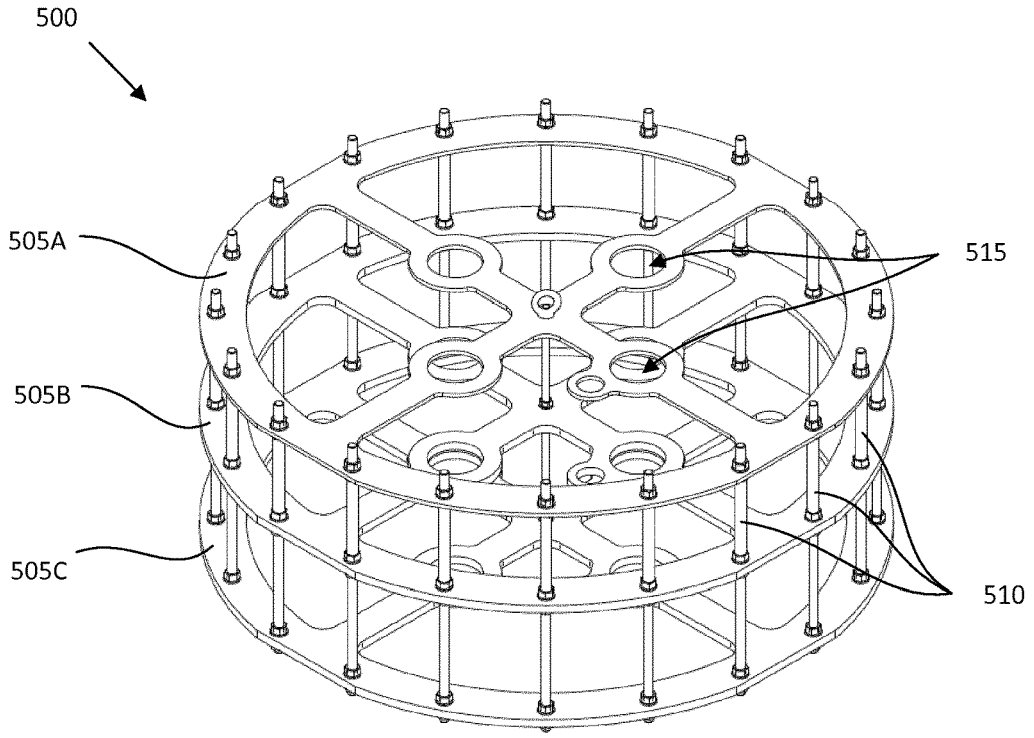
FIG. 5A shows a perspective view of the anchoring plate used to secure the seating area chassis.
Figure 5B:
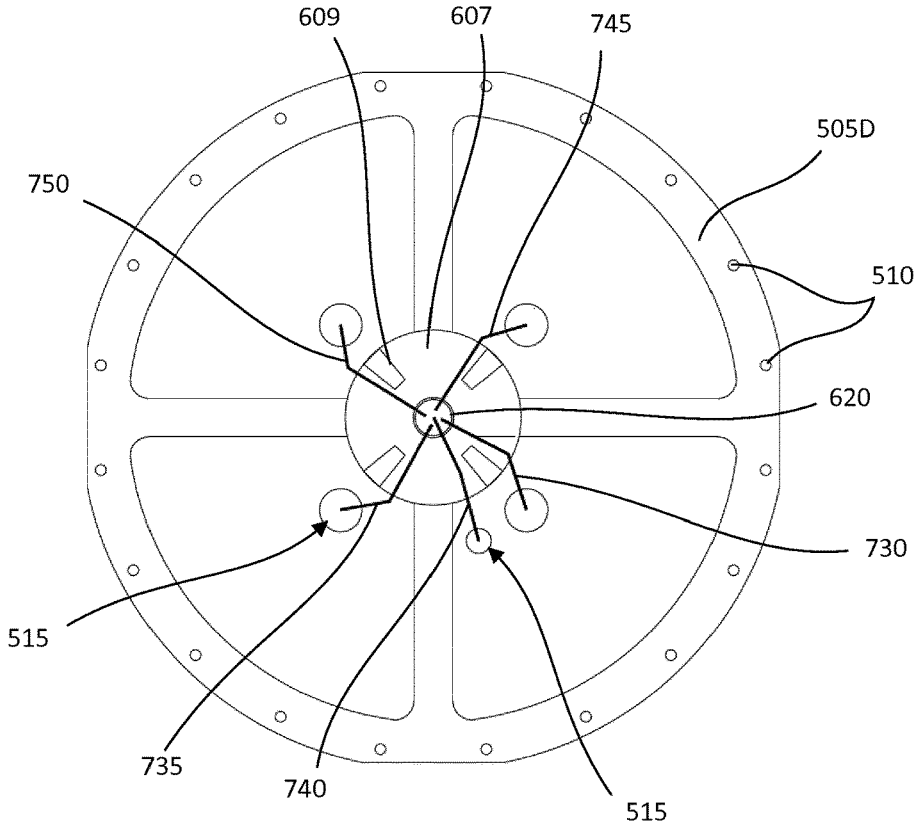
FIG. 5B shows a plan view of the anchoring plate with electrical connections passing through the anchoring plate.

FIG. 5A shows a perspective view of the anchoring plate used to secure the seating area chassis. The anchoring plate 500 is secured to steel rods which form part of the steel-reinforced concrete floor before being cast in the foundations. The anchoring plate 500 is used to secure the hub 325 of the chassis 300 to the theatre floor. The anchoring plate 500 is formed of a series of plate elements 505 each with a series of cable holes 515 and a series of support member holes to ensure the chassis 300 is optimally mounted on the anchoring plate 500. The anchoring plate 500 receives the electrical cables that are fed through channels 515 underground beneath the auditorium. The plate elements 505 are substantially flat surfaces stacked vertically and are connected to one another by a series of support members 510. Once the anchoring plate 500 is buried in the theatre floor, the top plate element 505A is removed and a new plate element 505D is mounted to the anchoring plate 500 and is the connection between the anchoring plate 500 and the chassis 300. This new plate element 505D is mounted with a 45 degrees rotation relative to the cast plate elements 505B, 505C so that the electrical cable outputs can pass easily from the anchoring plate 500 to a helical cable conduit arrangement (not shown) used to distribute the electrical cables to operate the various systems located around the chassis 300. FIG. 5B shows a plan view of the buried anchoring plate 500 with the new plate element 505D attached. The cables necessary to operate the different theatre systems 730, 735, 740, 745, 750 are shown passing from the buried channels 515 over the base plate 607 of the helical cable conduit base structure 605 and around the base structure struts 609 before entering the central channel 620 of the helical cable conduit arrangement 600. The electrical cables carry data and/or power for lighting signals 730, video and closed-circuit television systems 735, automation systems 740, building systems 745 and audio systems 750. Building systems may include seating lights, safety lights and emergency lighting.

Figure 5C:
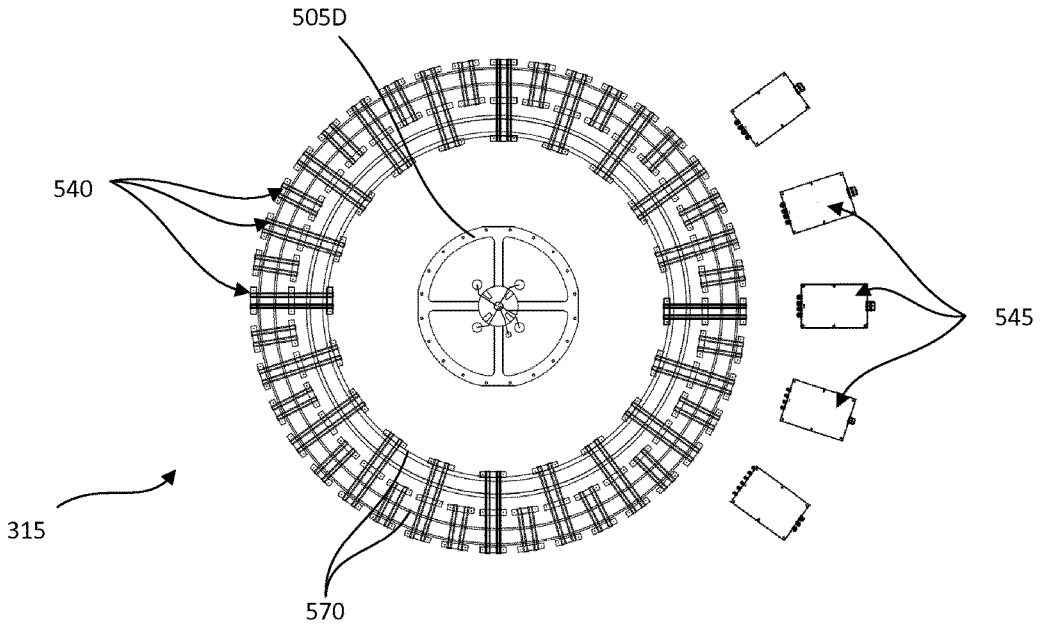
FIG. 5C shows a schematic illustration of the slipring used to distribute power to the revolving auditorium.
Figure 5D:
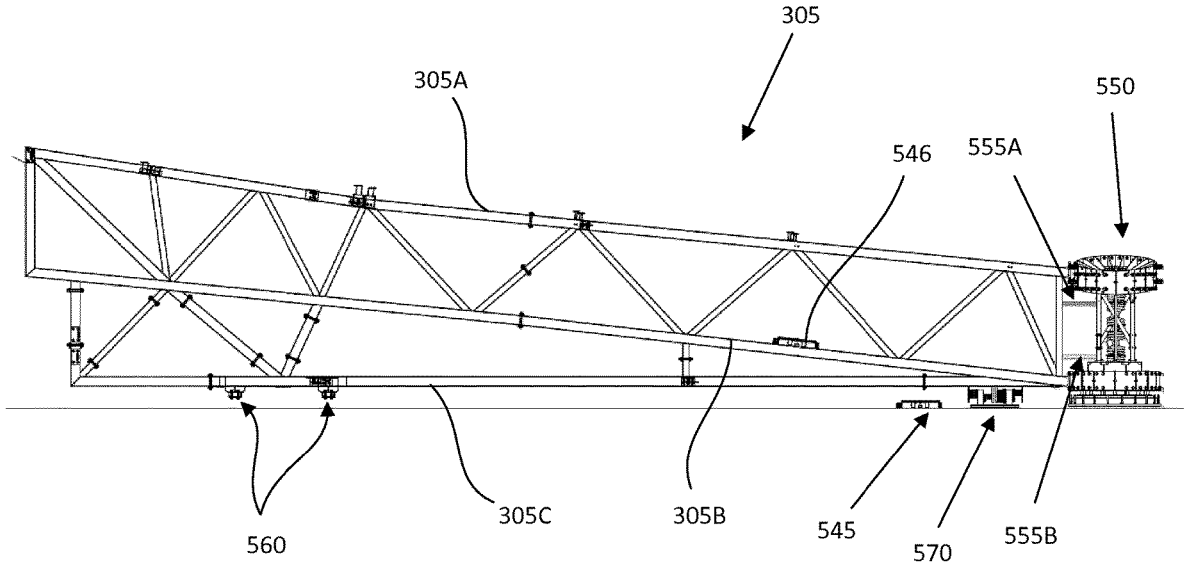
FIG. 5D shows a side section view showing the electrical connections passing between the helical cable conduit arrangement and one spoke of the chassis.

FIG. 5C shows a schematic illustration of the slipring used to distribute power through the auditorium. The electrical conductor or slip ring system 315 is formed of a series of concentric electrical tracks 570 mounted on a series of brackets 540 distributed around the hub. The brackets 540 are used to support the electrical tracks 570 and are anchored to the floor. The conductor system 315 is centred around the buried anchoring plate 500. The conductor system 315 has a series of electrical cabinets 545 distributed around the periphery of the conductor system 315. The electrical cabinets 545 are electrically connected to respective electrical tracks 570 in order to supply electrical power to the tracks 570. Electrical contact elements extend from the bottom portion 305C of the spokes 305 and engage with respective electrical tracks 570. The electrical contact elements slidably contact the electrical tracks 570 so that electricity can be transferred to the chassis as the chassis rotates. As shown in FIG. 5D, corresponding chassis electrical cabinets 546 are provided on the spokes 305 and are electrically connected to a respective electrical contact element and hence to a respective electrical track 570. Each electrical track 570 can carry a different voltage and maximum current in order to supply the different systems of the rotating chassis 300. In this way, the electrical tracks 570 and electrical contact elements provide a slipring arrangement that transfers electrical power from the stationary electrical cabinets 545 to the chassis electrical cabinets 546 on the rotating chassis 300.

FIG. 5D shows a side section view showing the different cables passing between the helical cable conduit arrangement and one spoke of the chassis. An arrangement of helical cable conduits 550 (commercially available as "Twisterband") is used to channel electrical bundles 555A, 555B through the hub so that the electrical cables are not damaged and the data signals transmitted through the cables are not distorted when the chassis rotates. The helical cable conduit arrangement 550 of the present system preserves the quality of the sound output heard by the audience and prevents the electrical cables being damaged when the chassis 300 is rotating. The helical cable conduit arrangement 550 is mounted on the anchoring plate 500 and is connected to the spokes 305 of the chassis 300. The electrical connection cabinet 545 is mounted to the floor of the theatre and located below the bottom portion 305C of the spokes 305. Located adjacent to the electrical connection cabinet 545 are the series of electrical tracks 570 that make up the conductor system 315. The electrical contact elements of the bottom spoke 305C are arranged to contact the electrical track 570 dependent on the power requirements of the different electrical systems. The electrical bundles 555A, 555B are channeled through the central 305B and upper 305A portions of the spoke 305 respectively. A series of connection plates 560 are also located on the bottom portion 305C of the spoke to connect the motorized bogies 310 (not shown).

Figure 6A:
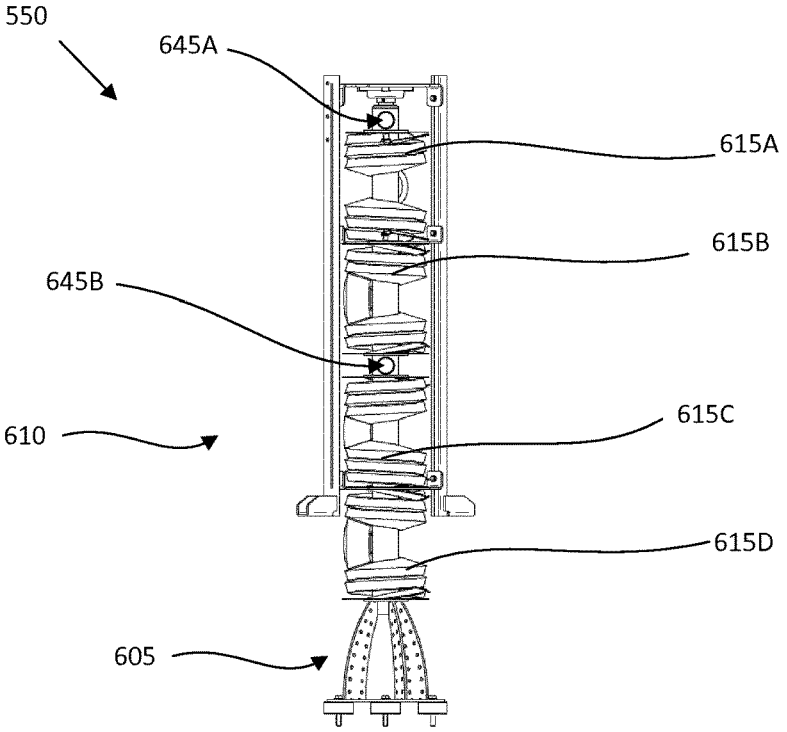
FIG. 6A shows a side view of the helical cable conduit arrangement.
Figure 6B:
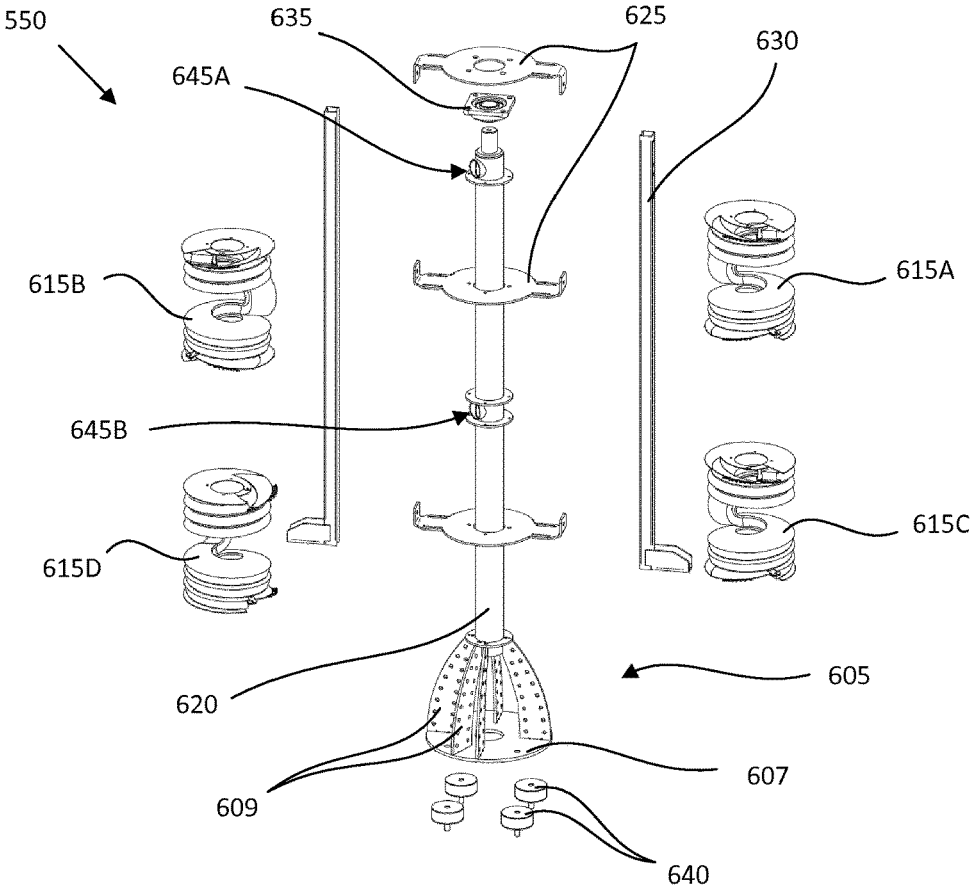
FIG. 6B shows an exploded view of the helical cable conduit arrangement.

FIGS. 6A and 6B best illustrates the helical cable conduit arrangement. Due to the large number of electrical cables needed to operate the present system, using a single helical cable conduit would be problematic. As shown, the helical cable conduit arrangement 550 is formed of a base structure 605 and a helical cable conduit stack 610 made up of four individual helical cable conduits 615. FIG. 6B shows an exploded view of the helical cable conduit arrangement. Each helical cable conduit 615 has a first portion forming a helix in a first direction of rotation and a second portion forming a helix in a direction opposite to the first direction of rotation and connected to the first portion by a reversing portion. In use, as one end of the helical cable conduit 615 is rotated relative to the other, the first portion is wound up while the second portion unwinds (or vice versa). This has the effect of moving reversing portion along one of the helixes. The cables located within the helical cable conduit 615 remain untwisted. As shown, the helical cable conduit stack 610 is mounted about a central shaft 620 extending from the base structure 605 through the central core of each helical cable conduit 615. This allows the chassis 300 to perform up to seven continuous rotations. Two of the helical cable conduits 615A and 615C are mounted upside down to helical cable conduits 615B and 615D in order to reduce the number of access ports 645 in the central shaft 620. By mounting the helical cable conduits 615 in this manner, only two access ports 645 are needed to provide sufficient access to the four helical cable conduits 615. The central shaft 620 comprises upper 645A and lower 645B access ports to provide an outlet from which the bundles of electrical cables 555A, 555B within the central shaft 620 may be passed to different helical cable conduits 615. The upper access port 645A is approximately located at the opposite end to the base support 605 and the lower access port 645B is located approximately midway along the central shaft 620. The helical cable conduits 615 are adjacent to a series of support plates 625 mounted on the central shaft 620 that support each helical cable conduit 615. To further secure the helical cable conduit stack 610, a series of guide rails 630 are located around the outer edge of the helical cable conduits 615 and secured to each of the support plates 625 by an engaging surface and a bearing 635 is located at the top of the stack of helical cable conduits 615. To prevent the transmission of vibrations through the helical cable conduit arrangement 550, a series of vibration dampers 640 are mounted to the underside of the base structure 605 which is secured to the anchoring plate 500.

Figure 7:
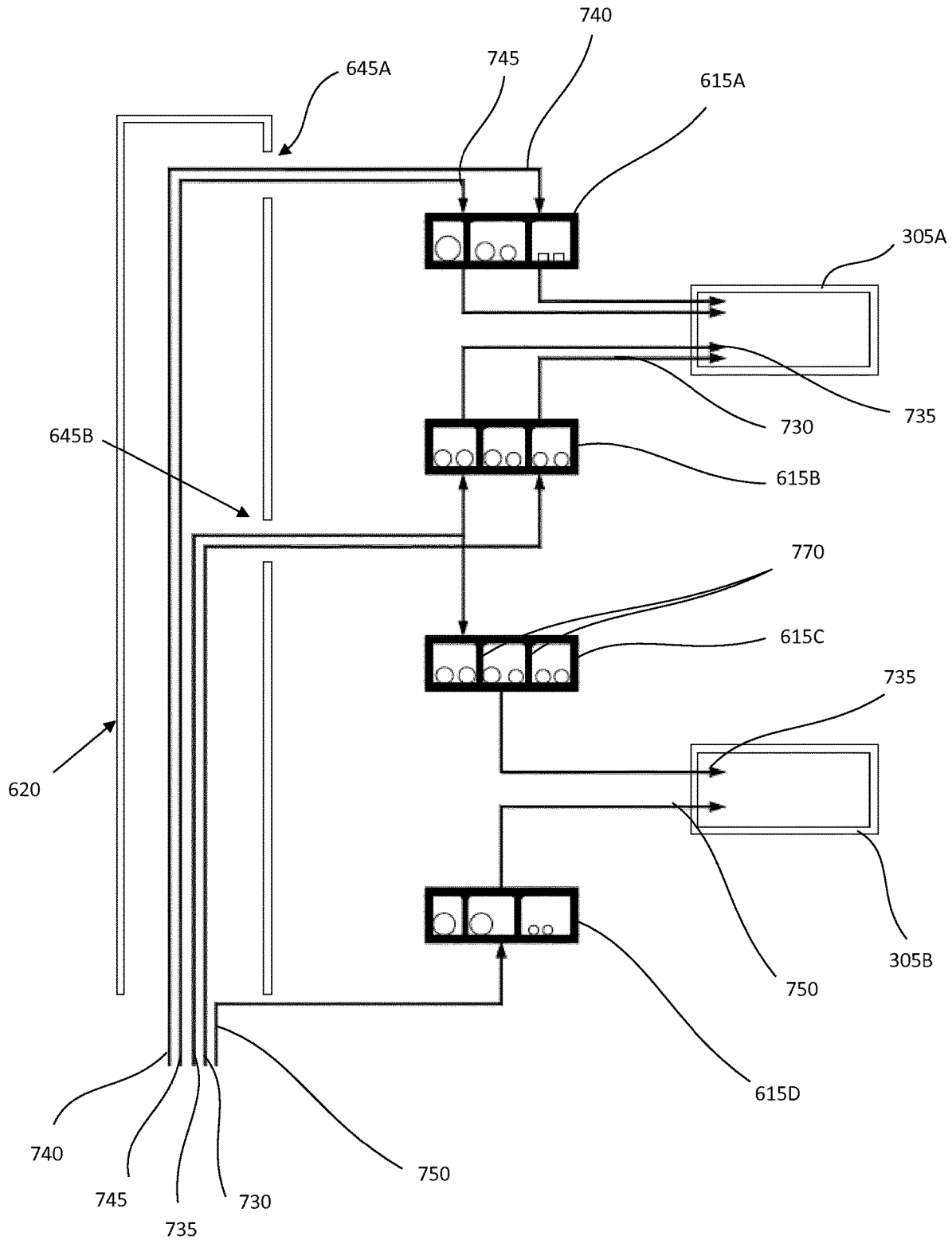
FIG. 7 shows a schematic illustration of the electrical connections provided by each helical cable conduit.

FIG. 7 shows a schematic illustration of the electrical connections provided by each helical cable conduit. The electrical cables for these systems are passed from the theatre floor to the helical cable conduits 615 via the access ports 645 in the central shaft 620. Each helical cable conduit 615 may contain cable separators 770 to provide separate regions within the helical cable conduit to facilitate installation and maintenance of the helical cable conduit stack 610. The electrical systems include lighting systems 730, video systems 735, automation 740 systems and building/safety systems 745. It should be noted that the cables for the audio systems 750 are not run through the central core, but only passed through helical cable conduit 615D before being channeled through the intermediate portion 305B of the spokes 305. The video system 735 and lighting system 730 cables are run through the central shaft 620 and pass through the lower access port 645B with the cabling for the video systems 735 being divided between two helical cable conduits 615B, 615C. The cabling for the lighting system 730 is passed to helical cable conduit 615B and is subsequently channeled through the top portion 305A of the spokes 305. The video system cables 735 that are passed to helical cable conduit 615B are also channeled through the top portion 305A of the spokes 305, whereas the video cables 735 that are passed to helical cable conduit 6150 are channeled to the intermediate portion 305B of the spokes 305. The automation 740 and building system 745 cables pass through the upper access port 645A and enter helical cable conduit 615A before being channeled through the upper portion 305A of the spokes 305. This helical cable conduit arrangement 550 enables all systems of the theatre to be safely and efficiently moved from the static frame of the theatre to the revolving frame of the chassis 300.

Image and Sound Synchronisation

The challenge of aligning multiple projectors to produce a seamless scene on the curved surface of the screen 135 whilst the system is moving and having the relevant speakers 175 provide the correct audio output is a challenge the present system has overcome. As the line array of speakers 175 are distributed around the round truss 134 which remains static, and the projectors are mounted to the projector platform 165 on the bridge 125 which rotates with the seating area 120, the audio and lighting controls need to be synchronised so that what the audience hears is aligned with the image they are seeing. If this is done poorly, the audience will notice and be distracted.

The present system achieves this through a combination of features. Firstly, a 0-5V output signal from the automation controller 320 of the chassis 300 is used to determine the orientation of the chassis 300. This analogue output signal is fed into a D-Mitri Digital Audio Platform system via an analogue to digital converter. The D-Mitri system has two general purpose input output (DGPIO) channels and the automation controller output signal is input to the DGPIO as a digital input. This allows the sound and lighting controller to be synchronised with the orientation of the chassis 300. To further minimise audio distortion, both DGPIO channels, the Midi line drivers and the master clock are placed in a rack which is fed by the same power supply and have the same ground as the automation system. If this is not done, the automation system may be heard in the audio output. The present configuration avoids distortion due to the automation system. Finally, as the triacs in the automation rack cause considerable distortion in the power supply, it is best to avoid any ground loops to the rest of the audio system. By powering the audio system from the same power supply as the automation system, the ground connection is isolated from the rest of the system. This includes the Midi cabling. The DGPIO is able to distribute the master clock timing over the rest of the audio/lighting network. By keeping the audio cable 750 in the helical cable conduit 615D, the present system is able to run the audio cable through the chassis 300 without twisting the cable and distorting the audio output. Additionally, by using a helical cable conduit 615 to transfer the audio signal from source to output, audio quality is preserved.

Emergency Systems

As a theatre typically has large amounts of high voltage equipment and a significant amount of flammable materials, such as costumes, sets and electrical cabling, fire safety is of paramount importance. Complying with regulatory requirements often means signage and fire extinguishing equipment must be readily accessible at all times. However, such objects will detract from the performance, as the audience will be able to locate themselves in the theatre building using the locations of illuminated signs and fire safety equipment around the building. The present application presents several innovative fire safety measures that comply with regulatory requirements whilst not detracting from the quality of the performance.

Figure 1J:
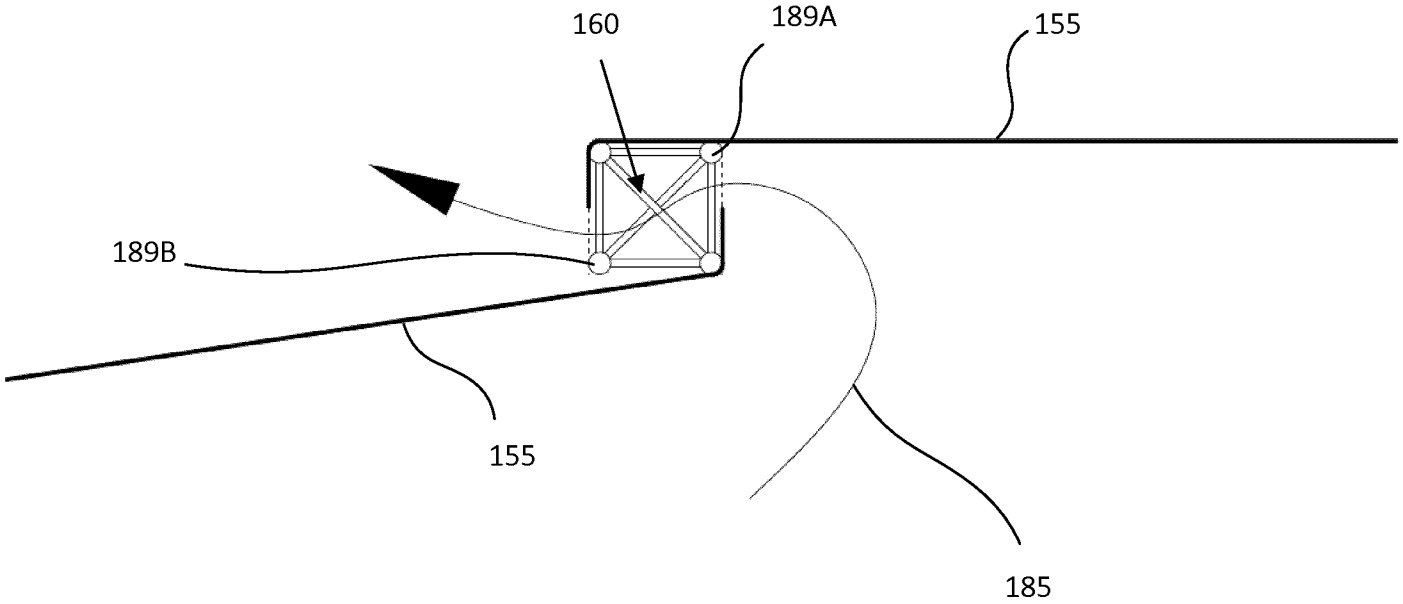
FIG. 1J shows a side section view of a chimney arrangement to evacuate smoke from the drum.

FIG. 1C shows a side section view of the drum 105, the crown truss 160 and cloth ceiling 155 attached to the round truss 134. This particular arrangement utilises a mesh ceiling 155. In the event of a fire, the mesh ceiling 155, the masking 157 and the screens 135 are all fire-retardant. By hanging the screens 135 on adjacent rails, it is possible to create overlap between the screens 135 which further enhances the fire safety capability of the screens 135. This deters fire from going between the auditorium 105 are and the area behind the screens 135. However, the mesh itself is breathable and allows air to flow through the mesh ceiling and vent 185 which allows smoke to vent from the auditorium into the ceiling of the building 100 to be vented out of the building 100. The arrangement shown in FIG. 1D illustrates a cloth ceiling 155 arranged in a chimney configuration. The flannel ceiling 155 is a solid cloth fabric that channels air into an air flow path 185. Having a solid flannel cloth ceiling 155 is preferable to a mesh ceiling for reasons of light blocking. Where the cloth ceiling 155 is made of flannel, the crown truss 160 and flannel ceiling 155 can form a chimney to vent air from the drum 105. As shown in FIG. 1J, the cloth ceiling 155 is mounted to the crown truss 160 at two mounting points 189. This particular arrangement is preferred as it provides the ability to vent air and smoke through the gaps in the crown truss 160, while providing overlapping areas of cloth ceiling 155 which substantially prevents light from entering the drum 105. Using either of a solid cloth ceiling or a mesh ceiling, the present theatre construction is able to prevent any significant build-up of smoke in the drum 105 and allows performers and audience members to evacuate the theatre safely. The masking 157 is also arranged to form overlapping layers around the drum, as this not only enhances its light-blocking abilities, but also provides a more robust fire-retardant layer around the drum 105 which will prevent fires being able to pass into and out of the drum 105.

Examples of appropriate material for masking the various structures within the theatre 100 include Sharkstooth FALSTAFF gauze, Buhnenmolton R55 stage flannel and sheer muslin speaker gauze. The ceiling mesh 155 covering the crown truss 160 may be made from Sharkstooth FALSTAFF material, while the bridge 125, round truss 134, support poles 132 and bottom of the screens 135 may be masked with Buhnenmolton R55. The border in front of the line array of speakers 175 may be masked using sheer muslin cloth. These materials are given as examples of appropriate cloth materials, but other materials with the necessary masking qualities are envisaged. It is envisaged that suitable materials will be lightweight, but may not necessarily be entirely opaque or mesh-like.

Figure 9D:
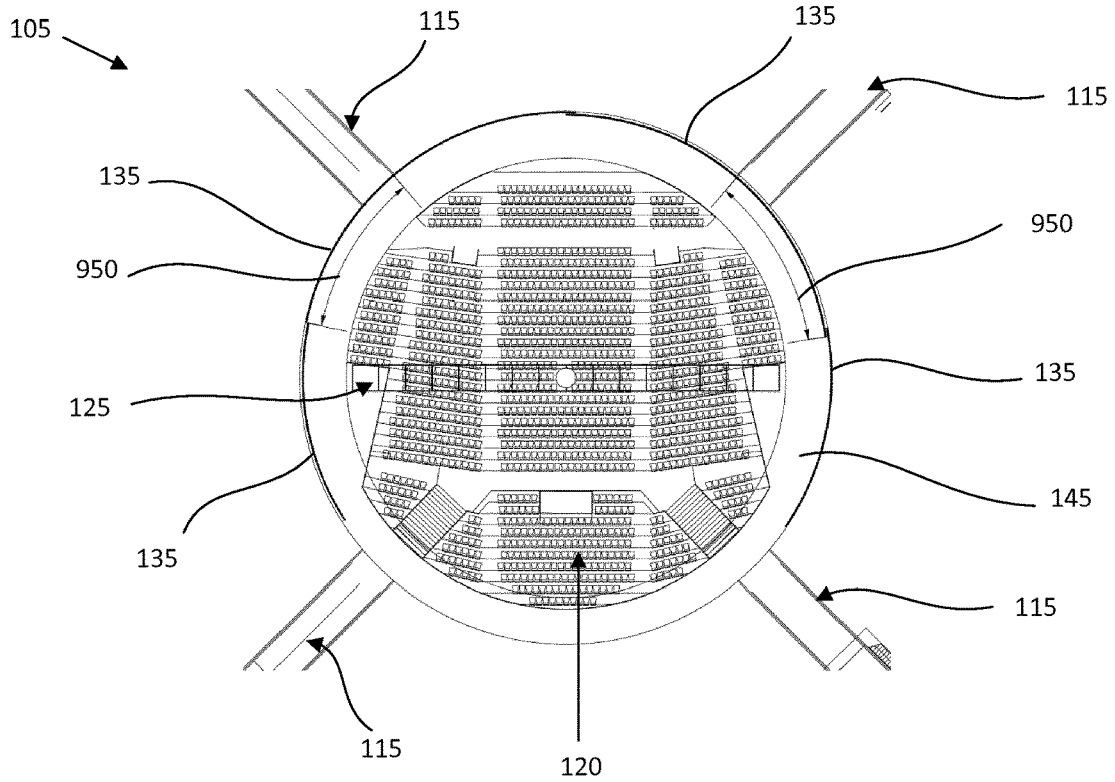
FIG. 9D shows a plan view of the theatre showing the largest distance the screens need to travel in an emergency.
Figure 9E:
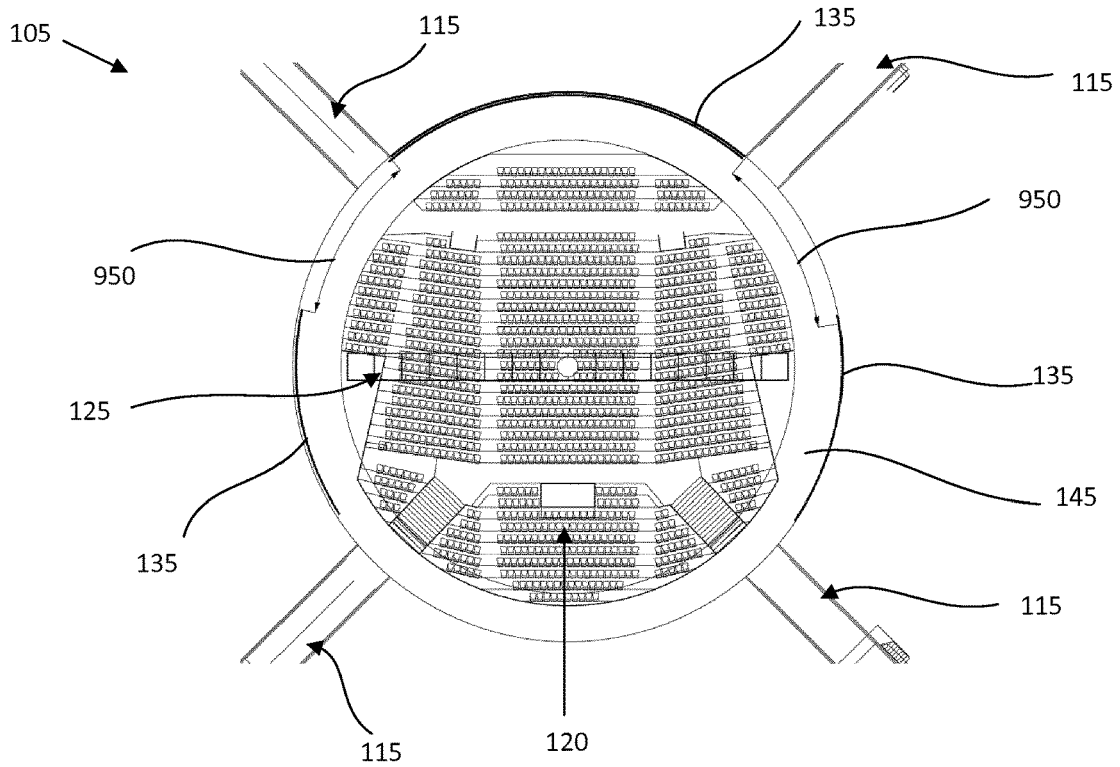
FIG. 9E shows a plan view of the theatre with the screens in exemplary emergency positions.

As the screens 135 are able to move during the performance, there is a risk the screens will be located in front of an emergency exit when a fire is detected, such as shown in FIG. 9D. This risk is mitigated again by having all screens 135 move to an emergency position as shown in FIG. 9E in the event of an emergency so that all emergency exits 115 are accessible and the audience is able to evacuate as quickly as possible. It should be noted, that the default position of a screen 135 may not be its emergency position. In an emergency, each screen is moved into the nearest position such that no emergency exits 115 are obstructed. Depending on the particular location of a screen, this may be different to the default screen position. The large screens 135 are sized to be slightly less than a quarter of the circumference of the round truss 134, in particular one quarter of the circumference of the round truss 134 less the width of one emergency exit. This ensures a large screen is not able to block two emergency exits 115 at any point. Small screens may be approximately half the size of a large screen. As shown, four emergency exits 115 are equally spaced around the drum 105. However, if more emergency exits are required, for example, due to regulatory requirements, then more exits 115 can be located around the drum 105 and the size of the large screens may be adjusted accordingly. The screens 135 are designed to ensure that even if the maximum amount of screen travel 950 is required to open an emergency exit 115 and the screens 135 are driven at half their maximum speed, all exits will be unblocked within 38 seconds. If the screens 135 are driven at their maximum speed, this time is reduced to 30 seconds. The power supply for the screen motors are located near a support pole 132 and are connected to an uninterruptible power supply (UPS) large enough to actuate the screens 135 for one hour. This is important where the screens are obstructing one of the emergency exits 115 and there is an emergency that requires the theatre to be evacuated.

Emergency lighting is also provided inside the drum 105 and attached to the bridge 125. Attaching the emergency lighting to the bridge 125, ensures the audience members always have emergency lighting when the theatre needs to be evacuated.

Environmental Control

As shown in FIG. 1D, a fresh air inlet 186 located outside the theatre building 100 is used to introduce air through an underfloor system which has an air outlet 187 inside the drum 105. This air can then be passed through underfloor and in-seat vents 188 to provide ambient heating for the audience in the seating area 120. Vents may also be located in the walls, seat legs or steps depending on the configuration of the drum 105. Such a system can also extend to the front of house building where food and beverage facilities will be located that require separate heating and cooling depending on the ambient external conditions.

Aside from multiple air inlets 186 located outside the theatre building which can provide fresh air, air-conditioning and/or heating systems (not shown) mounted on the roof or walls of the theatre 100 may provide conditioned air directly into the theatre. Such a system can be used in combination with the fresh air inlet 186 to provide optimal conditions. A forced air system can be used to introduce air through the gap between the annular floor 145 and the seating area floor 200. The forced air system draws air in from the inside of the theatre building or through an external ducting system 186, 187 and blows out air through the drum 105. As there is an imperfect seal between the revolving seating area floor 200 and the annular floor 145, it is possible to direct air from under the annular floor 145 into the drum 105 and create a curtain of air to ventilate the drum 105. The pressure head created by the forced air system will also drive air through the vents 188 located in seats or throughout the seating area 120. Effective venting will also be important to drive smoke from inside the drum 105 through the mesh ceiling 155 (or chimney) and out of the drum 105. As smoke and fire may form part of the performance, it is important to have proper environmental control of the theatre so that any smoke or heat that is generated, whether by accident or as part of the show, is quickly dispersed out of the drum 105. It is also conceivable that the seating floor area 200 may be located within a recess or generally on a floor area, where the floor area is not annular. This configuration is applicable to theatre constructions where there are no screens, such as in a cinema or at a live music performance. The ventilation and forced air systems described above would be equally applicable in such a scenario. Similarly, the ventilation and forced air systems described above would apply where there is no inter-leaving between the seating area floor 200 and the general theatre floor.

The seating area of the present system is able to rotate multiple times in the same direction while isolating the audience from visual cues that may allow them to orientate themselves during the performance. A novel cable management system provides power to the rotating chassis and ensures optimal sound quality is maintained regardless of the orientation of the auditorium and that the lighting and sound is synchronised to ensure there is no perceivable difference between the systems during the performance. Finally, a fire safety and emergency system that complies with regulatory requirements without compromising the quality of the performance has been devised. This results in a theatre performance system that provides audiences with a truly immersive experience that has not previously existed.

Throughout the description and claims of this specification, the words "comprise" and "contain" and variations of them mean "including but not limited to", and they are not intended to (and do not) exclude other components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics, compounds or groups described in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The invention is not restricted to the details of any foregoing embodiments. The invention extends to any novel one, or any novel combination, of the features disclosed in this specification (including any accompanying claims, abstract and drawings), or to any novel one, or any novel combination, of the steps of any method or process so disclosed.

The invention claimed is:

1. A theatre construction comprising:

a seating area for an audience;

a circular support structure surrounding the seating area and mounted above the seating area;

a plurality of arcuate screens suspended from the circular support structure, the screens being mounted to the circular support structure on rails for allowing movement of the screens about the seating area, and counterweights suspended from the rails for movement about the seating area, the counterweights being arranged to preload the circular support structure, whereby to prevent perceptible sagging of the circular support structure when a screen is moved into a position on the circular support structure previously occupied by the counterweights.

2. A theatre construction as claimed in claim 1, wherein the rails are circular and at least one rail is fully populated with counterweights in the space not occupied by the screens.

3. A theatre construction as claimed in claim 1, wherein the counterweights are driven along the rails by the movement of the screens.

4. A theatre construction as claimed in claim 1, wherein the circular support structure comprises a plurality of rails mutually spaced in a radial direction of the circular support structure, each rail suspending at least one respective screen, whereby the respective screens can pass each other.

5. A theatre construction comprising:

a seating area for an audience;

a circular support structure surrounding the seating area and mounted above the seating area;

a plurality of arcuate screens suspended from the circular support structure, the screens being mounted to the circular support structure on rails for allowing movement of the screens about the seating area, wherein said rails are mutually spaced in a radial direction of the circular support structure, each rail of said rails suspending at least one respective screen, whereby the respective screens can pass each other, and wherein a first screen is suspended from a first rail of said rails by a hanger having a substantially C-shaped cross section, whereby the hanger accommodates a second rail of said rails suspending a second screen below the first rail.

6. A theatre construction as claimed in claim 5, wherein said rails are mounted to the circular support structure by means of a plurality of adjustable connectors spaced in the circumferential direction of the circular support structure, whereby the vertical position of said rails can be adjusted to provide a substantially horizontal rail independently of any deformation of the circular support structure.

7. A theatre construction as claimed in claim 5 further comprising a drive loop provided about the circular support structure and arranged to engage at least one of the screens, whereby to move the screen about the seating area on said rails.

8. A theatre construction as claimed in claim 5, wherein the screens are each locatable in an emergency position about the seating area in which emergency position the screen does not obstruct an emergency exit from the seating area and the theatre construction comprises an emergency controller for the screens, wherein the emergency controller is configured to move each screen from a current position to the nearest emergency position for that screen in the event of an emergency.

9. A theatre construction as claimed in claim 5, wherein the circular support structure is supported on a plurality of vertical supports distributed about the circumference of the circular support structure and at least two further vertical tension members are provided between the circular support structure and the ground, whereby to enhance the rigidity of the circular support structure.

10. A theatre construction as claimed in claim 5 comprising a ceiling covering suspended over the circular support structure, wherein the ceiling covering is configured substantially to prevent the ingress of light to the seating area while allowing the egress of smoke from the seating area in the event of a fire.

11. A theatre construction as claimed in claim 5, wherein the screens are formed of a polymer foam material laminated with at least one layer of further material.

12. A theatre construction as claimed in claim 5, wherein the seating area is mounted for rotation about a vertical axis, wherein the seating area is mounted for rotation on a central bearing and is supported at its periphery by a plurality of bogies, each bogie having at least one driven wheel, whereby the bogies are arranged to drive rotation of the seating area.

13. A theatre construction as claimed in claim 12 further comprising a plurality of flexible helical cable conduits located about a fixed central cable conduit, whereby to provide a cable path between a fixed location of the theatre construction and the seating area, each helical cable conduit comprising a first portion forming a helix in a first direction of rotation and a second portion forming a helix in a direction opposite to the first direction of rotation and connected to the first portion by a reversing portion between the first and second portions, wherein the fixed central cable conduit has defined therein a plurality of cable ports spaced in a vertical direction, each flexible helical cable conduit being connected to one of the cable ports whereby to form a stack of helical cable conduits.

14. A theatre construction as claimed in claim 12 further comprising an audio system for controlling the audio output to the audience and an automation system for controlling rotation of the seating area, wherein the audio system and the automation system are powered by a common power supply provided within the seating area.

* * * * *